US010647022B2

(12) United States Patent
Nagai et al.

(10) Patent No.: US 10,647,022 B2
(45) Date of Patent: May 12, 2020

(54) SHEET MANUFACTURING APPARATUS AND SHEET MANUFACTURING METHOD

(71) Applicant: SEIKO EPSON CORPORATION, Tokyo (JP)

(72) Inventors: Yoshiyuki Nagai, Nagano (JP); Takao Mikoshiba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/772,331

(22) PCT Filed: Nov. 7, 2016

(86) PCT No.: PCT/JP2016/082933
§ 371 (c)(1),
(2) Date: Apr. 30, 2018

(87) PCT Pub. No.: WO2017/082193
PCT Pub. Date: May 18, 2017

(65) Prior Publication Data

US 2018/0319038 A1 Nov. 8, 2018

(30) Foreign Application Priority Data

Nov. 9, 2015 (JP) ..... 2015-219216
Jun. 29, 2016 (JP) ..... 2016-128525

(51) Int. Cl.
*D04H 1/60* (2006.01)
*B27N 3/12* (2006.01)
(Continued)

(52) U.S. Cl.
CPC ..... *B27N 3/12* (2013.01); *B27N 1/029* (2013.01); *B27N 3/04* (2013.01); *B27N 3/18* (2013.01); *D04H 1/60* (2013.01); *D21F 9/00* (2013.01)

(58) Field of Classification Search
USPC ..... 162/202
See application file for complete search history.

(56) References Cited

U.S. PATENT DOCUMENTS 9,074,320 B2 * 7/2015 Gomi ..... D21F 3/08
2003/0111775 A1 6/2003 Ukai
(Continued)

FOREIGN PATENT DOCUMENTS

JP 2001-113509 A 4/2001
JP 2001-322106 A 11/2001
(Continued)

*Primary Examiner* — Mark Halpern
(74) *Attorney, Agent, or Firm* — Global IP Counselors, LLP

(57) ABSTRACT

The sheet manufacturing apparatus includes an accumulation unit that accumulates a material containing a fiber and a resin; a heating unit that includes a first rotating body and a second rotating body and heats a sediment accumulated by the accumulation unit; a displacement mechanism that displaces the heating unit to a first position where the first rotating body and second rotating body nip and heat the sediment and a second position where the first rotating body and the second rotating body are separated from each other; and a controller that displaces the first rotating body and the second rotating body to the first position after heating the first rotating body and the second rotating body in the second position.

6 Claims, 16 Drawing Sheets

(51) Int. Cl.

| | |
|---|---|
| ***B27N 3/04*** | (2006.01) |
| ***B27N 3/18*** | (2006.01) |
| ***D21F 9/00*** | (2006.01) |
| ***B27N 1/02*** | (2006.01) |

(56) References Cited

U.S. PATENT DOCUMENTS

| | | | | |
|---|---|---|---|---|
| 2015/0096703 | A1* | 4/2015 | Fujita | B65H 29/125 162/286 |
| 2015/0204015 | A1* | 7/2015 | Gomi | B29C 35/02 162/261 |
| 2015/0247286 | A1 | 9/2015 | Nagai | |
| 2015/0275430 | A1 | 10/2015 | Higuchi et al. | |
| 2016/0168795 | A1* | 6/2016 | Fujita | D21F 9/00 162/261 |
| 2016/0229093 | A1 | 8/2016 | Gomi | |
| 2018/0237992 | A1* | 8/2018 | Nagai | D04H 1/54 |

FOREIGN PATENT DOCUMENTS

| | | | |
|---|---|---|---|
| JP | 2002-154176 | A | 5/2002 |
| JP | 2004-086219 | A | 3/2004 |
| JP | 2007-056409 | A | 3/2007 |
| JP | 2009-098353 | A | 5/2009 |
| JP | 2015-080853 | A | 4/2015 |
| JP | 2015-161047 | A | 9/2015 |
| JP | 2015-183336 | A | 10/2015 |

* cited by examiner

SHEET MANUFACTURING APPARATUS AND SHEET MANUFACTURING METHOD

CROSS-REFERENCE TO RELATED APPLICATIONS

This application is a U.S. National stage application of International Patent Application No. PCT/JP2016/082933, filed on Nov. 7, 2016, which claims priority under 35 U.S.C. § 119(a) to Japanese Patent Application No. 2015-219216, filed in Japan on Nov. 9, 2015 and Japanese Patent Application No. 2016-128525, filed in Japan on Jun. 29, 2016. The entire disclosures of Japanese Patent Application Nos. 2015-219216 and 2016-128525 are hereby incorporated herein by reference.

TECHNICAL FIELD

The present invention relates to a sheet manufacturing apparatus and a sheet manufacturing method.

BACKGROUND ART

Japanese Unexamined Patent Application Publication No. 2001-113509 discloses a manufacturing apparatus in which a mat-shaped composition, in which a heat-curable resin and a radical initiator are added to powdery or fibrous raw material, is thermally pressed with a thermal pressure roller to form a fibrous plate. The thermal pressure roller in this manufacturing apparatus can apply a temperature of 110° C. to 260° C. and a linear pressure corresponding to a pressure of about 10 to 150 kgf/cm$^2$ to the mat-shaped composition.

However, in the manufacturing apparatus described above, at the time of activating the apparatus, when warming up is performed while transporting the mat-shaped composition remaining between the thermal pressure rollers (heating is performed until the thermal pressure roller reaches a predetermined temperature), it was not possible to sufficiently heat the mat-shaped composition.

In addition, in the manufacturing apparatus described above, there is a problem that when a transport process of the mat-shaped composition is stopped, the mat-shaped composition comes into contact with the thermal pressure roller, and is affected by heating with the thermal pressure roller, and thereby the resin contained in the mat-shaped composition is dissolved and the mat-shaped composition sticks to the thermal pressure roller.

An object of some aspects of the present invention is to provide a sheet manufacturing apparatus and a sheet manufacturing method capable of reducing defects due to insufficient heating or the like.

SUMMARY

The present invention has been made to solve at least a part of the above problems, and can be realized as the following aspects or application examples.

Application Example 1

According to this application example, there is provided a sheet manufacturing apparatus which manufactures a sheet by using a raw material containing a fiber, the apparatus including an accumulation unit that accumulates a material containing a fiber and a resin; a heating unit that includes a first rotating body and a second rotating body and heats a sediment accumulated by the accumulation unit; a displacement mechanism that displaces the heating unit to a first position where the first rotating body and second rotating body nip and heat the sediment, and a second position where the first rotating body and the second rotating body are separated from each other; and a controller that displaces the first rotating body and the second rotating body to the first position after heating the first rotating body and the second rotating body in the second position.

In the sheet manufacturing apparatus, when the sediment is nipped and heated by the first rotating body and the second rotating body after heating the first rotating body and the second rotating body in the position where the first rotating body and the second rotating body are separated from each other, it is possible to reduce defects due to insufficient heating or the like.

Application Example 2

According to this application example, there is provided a sheet manufacturing apparatus which manufactures a sheet by using a raw material containing a fiber, the apparatus including an accumulation unit that accumulates a material containing a fiber and a resin; a heating unit that includes a first rotating body and a second rotating body and heats a sediment accumulated by the accumulation unit; and a displacement mechanism that displaces the heating unit to a first position where the first rotating body and second rotating body nip and heat the sediment, and a second position where the first rotating body and the second rotating body are separated from each other, in which the heating unit is configured such that each of the first rotating body and the second rotating body is rotatably driven in the second position.

In the sheet manufacturing apparatus, when the first rotating body and the second rotating body are rotated in the position where the first rotating body and the second rotating body are separated from each other, it is possible to make surface temperatures of the first rotating body and the second rotating body uniform, thereby reducing defects due to insufficient heating or the like.

Application Example 3

The sheet manufacturing apparatus according to the application example may further include a controller that displaces the heating unit to the first position from the second position after a temperature of the heating unit reaches a predetermined temperature at the time of starting transport of the sediment.

In the sheet manufacturing apparatus, when the sediment is nipped and heated by the first rotating body and the second rotating body after the temperature of the heating unit reaches a predetermined temperature at the time of starting the transport of the sediment, it is possible to prevent the strength of the sheet from being partially lowered due to insufficient heating at the start of transport, and to make the strength of the sheet uniform.

Application Example 4

The sheet manufacturing apparatus according to the application example may further include a controller that displaces the heating unit to the second position from the first position at the time of stopping transport of the sediment.

In the sheet manufacturing apparatus, when the transport of the sediment is stopped, by displacing the first rotating body and the second rotating body to a position where those are separated from each other, it is possible to suppress discoloration and the like of the sediment due to overheating at the time of stopping the transport.

Application Example 5

In the sheet manufacturing apparatus according to the application example, when the heating unit is in the second position, a peripheral speed of the first rotating body may be different from a peripheral speed of the second rotating body.

Application Example 6

The sheet manufacturing apparatus according to the application example may further include a driving unit that rotatably drives the first rotating body, and a transmission mechanism that transmits a driving force of the driving unit to the second rotating body in the second position without transmitting the driving force of the driving unit to the second rotating body in the first position.

In the sheet manufacturing apparatus, the driving force is transmitted to the second rotating body by the driving unit in the second position, the second rotating body is driven in accordance with the first rotating body without transmitting the driving force to the second rotating body by the driving unit in the first position, and thereby it is possible stably transport the sediment by the first rotating body and the second rotating body.

Application Example 7

In the sheet manufacturing apparatus according to application example, the first rotating body and the second rotating body may be in contact with the sediment in the second position.

In the sheet manufacturing apparatus, it is possible to reliably prevent discoloration and the like of the sediment due to overheating at the time of stopping the transport.

Application Example 8

According to this application example, there is provided a sheet manufacturing method of manufacturing a sheet by using a raw material containing a fiber, the method including a step of accumulating a material containing a fiber and a resin; and a step of heating the accumulated sediment by using a heating unit which includes a first rotating body and a second rotating body, in which the heating unit is displaced from a position where the first rotating body and the second rotating body are separated from each other to a position where the first rotating body and the second rotating body nip and heat the sediment, after a temperature of the heating unit reaches a predetermined temperature at the time of starting transport of the sediment.

In the sheet manufacturing method, when the sediment is nipped and heated by the first rotating body and the second rotating body after the temperature of the heating unit reaches a predetermined temperature at the time of starting the transport of the sediment, it is possible to prevent the strength of the sheet from being partially lowered due to insufficient heating at the start of transport, and to make the strength of the sheet uniform.

Application Example 9

According to this application example, there is provided a sheet manufacturing apparatus which manufactures a sheet by using a raw material containing a fiber, the method including an accumulation unit that accumulates a material containing a fiber and a resin; a heating unit that includes a first rotating body and a second rotating body and heats a sediment accumulated by the accumulation unit; a displacement mechanism that displaces the heating unit to a first position where the first rotating body and second rotating body nip and heat the sediment and a second position where the first rotating body and the second rotating body are separated from each other; and a driving unit that rotates at least a rotating body on the side being in contact with the sediment in the second position.

According to this configuration, when the heating unit is displaced from the first position to the second position, the first rotating body and the second rotating body are separated from each other, and thereby the sediment is released from the nipped state. Further, the sediment in the second position is in a state of being contact with the rotating body during the rotation. With this, it is possible to prevent the sediment from sticking to the rotating body.

Application Example 10

In the sheet manufacturing apparatus according to the application example, the heating unit is positioned in the second position at the time of stopping the transport of the sediment.

According to this configuration, when the transport of the sediment is stopped, the heating unit is positioned in the second position, and thus it is possible to reliably prevent the sediment from sticking to the rotating body.

Application Example 11

In the sheet manufacturing apparatus according to the application example, rotation of the rotating body is stopped after the temperature of the rotating body on the side being in contact with the sediment is equal to or lower than a predetermined temperature.

According to this configuration, it is possible to reliably prevent the sediment from sticking to the rotating body, and to reduce power consumption of the rotating body.

Application Example 12

In the sheet manufacturing apparatus according to the application example, a rotational speed of the rotating body on the side being in contact with the sediment in the second position is higher than a rotational speed in the first position.

According to this configuration, the cooling of the rotating body is accelerated, and thus it is possible to reliably prevent the sediment from sticking to the rotating body.

Application Example 13

According to the application example, the sheet manufacturing apparatus further includes a pressurizing unit that pressurizes the sediment on the upstream side of the heating unit in the transport direction of the sediment, in which the pressurizing unit pressurizes the sediment when the heating unit is in the second position.

According to this configuration, the sediment is in a state of being pressurized by the pressurizing unit in the second position, and thus it is possible to prevent the sediment from being moved to downstream side in the transport direction. With this, it is possible to eliminate the waste of the sediment.

Application Example 14

According to the application example, the sheet manufacturing apparatus further includes a first transport unit that is positioned on the upstream side of the heating unit in the transport direction of the sediment, and is capable of transporting the sediment; and a second transport unit that is positioned on the downstream side of the heating unit in the transport direction of the sediment, and is capable of transporting the sediment, in which when the heating unit is in the second position, the sediment is reciprocated by the first transport unit and the second transport unit.

According to this configuration, in a case where the heating unit is in the second position, the sediment is reciprocated (reciprocally transported). With this, it is possible to disperse the amount of heat received in the sediment by radiant heat from the heating unit, and to prevent the sediment from sticking to the rotating body.

Application Example 15

According to the application example, the sheet manufacturing apparatus further includes a blower that blows air to the rotating body on the side being in contact with the sediment.

According to this configuration, the rotating body receives the air from the blower, the cooling of the rotating body can be accelerated.

Application Example 16

According to this application example, there is provided a method of controlling a sheet manufacturing apparatus which includes an accumulation unit that accumulates a material containing a fiber and a resin, a heating unit that includes a first rotating body and a second rotating body and heats a sediment accumulated by the accumulation unit, a displacement mechanism that displaces the heating unit to a first position where the first rotating body and second rotating body nip and heat the sediment and a second position where the first rotating body and the second rotating body are separated from each other, and a driving unit that rotates the first rotating body or the second rotating body, the method including rotating at least a rotating body on the side being in contact with the sediment in a case where the heating unit is displaced to the second position.

According to this configuration, in the case where the heating unit is displaced from the first position to the second position, the first rotating body and the second rotating body are separated from each other, and the sediment is in a state of being contact with the rotating body during the rotation. With this, it is possible to prevent the sediment from sticking to the rotating body.

DESCRIPTION OF EMBODIMENTS

Hereinafter, preferred embodiments of the invention will be described with reference to the drawings. Note that, in the following drawings, in order to make each member or the like to be clearly understandable, a scale of each member or the like made to be different from that in the actual structure. In addition, the embodiments described below do not unduly limit the contents of the present invention described in claims. Not all of the configurations explained below are indispensable configuration requirements in the invention.

First Embodiment

1. Overall Configuration

Figure 1:
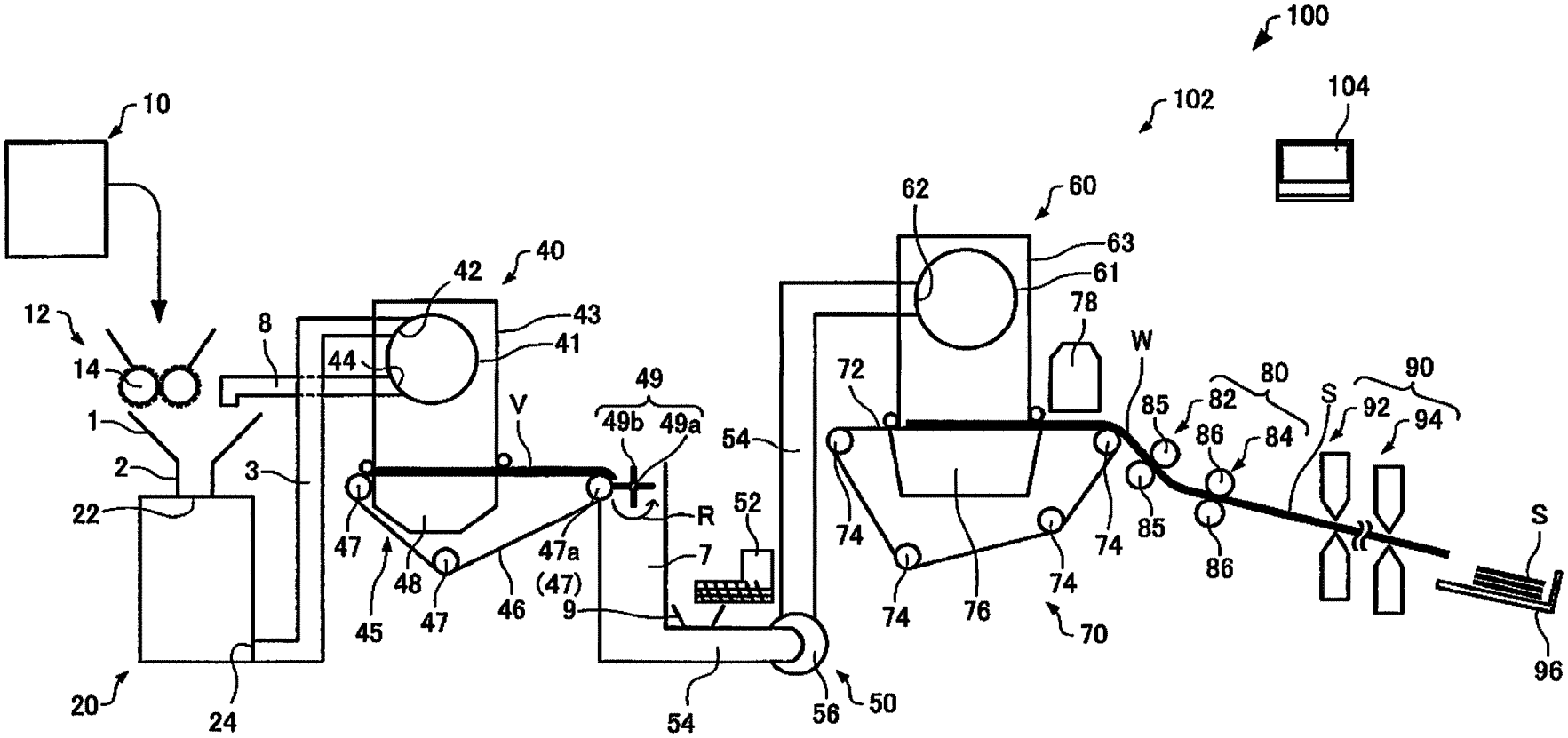
FIG. 1 is a diagram schematically illustrating a sheet manufacturing apparatus according to a first embodiment.

First, a sheet manufacturing apparatus according to the embodiment will be described with reference to the drawings. FIG. 1 is a drawing schematically showing a sheet manufacturing apparatus 100 according to the embodiment.

The sheet manufacturing apparatus 100 is provided with a supplying unit 10, a manufacturing unit 102, and a controller 104, as shown in FIG. 1. The manufacturing unit 102 manufactures a sheet. The manufacturing unit 102 includes a crushing unit 12, a defibrating unit 20, a screening unit 40, a first web forming unit 45, a rotating body 49, a mixing unit 50, an accumulation unit 60, a second web forming unit 70, a sheet forming unit 80, and a cutting unit 90.

The supplying unit 10 supplies raw materials to the crushing unit 12. The supplying unit 10 is an automatic feeding unit for continuously feeding the raw materials to the crushing unit 12. The raw materials supplied by the supplying unit 10 include fibers such as recycled pulp and pulp sheets.

The crushing unit 12 cuts the raw material supplied by the supplying unit 10 into small pieces in air. The shape and size of the small pieces is several cm squared. In the examples in the drawings, the crushing unit 12 includes a crushing blade 14, and it is possible for the fed raw materials to be cut by the crushing blade 14. A shredder is used as the crushing unit 12. The raw material cut by the crushing unit 12 is transmitted (transported) to the defibrating unit 20 via a pipe 2 once received by a hopper 1.

The defibrating unit 20 defibrates the raw material cut by the crushing unit 12. Here, the wording "defibrates" refers to untangling the raw material (material to be defibrated) in which a plurality of fibers are bonded into individual fibers. The defibrating unit 20 also has a function of causing substances such as resin powder bonded to the raw material, ink toner, or blur-preventing agent to be isolated from the fibers.

The material that passes through the defibrating unit 20 is referred to as a "defibrated material". There are also cases where resin (resin for causing a plurality of fibers to bond to one another) powder isolated from the fibers when the fibers are untangled, colorants such as ink and toner, and additives such as bleeding inhibitors and paper strengthening agents are included in the "defibrated material" in addition to the untangled defibrated material fibers. The shape of the untangled defibrated material is string-like or ribbon-like. The untangled defibrated material may be present in a state of not being entangled with other untangled fibers (independent state) or may be present in a state being entangled with other untangled defibrated material to form a clump (a state of forming a so-called "lump").

The defibrating unit 20 performs defibration in a dry manner. Here, performing a treatment such as defibration not in liquid but in air such as atmosphere is called a dry process. An impeller mill is used as the defibrating unit 20 in the embodiment. The defibrating unit 20 has the function causing an airflow to be generated so as to suction the raw material and discharge the defibrated material. With this, it is possible for the defibrating unit 20 to suction the raw material along with the airflow from an introduction port 22, perform the defibration treatment, and transport the defibrated material to the exit port 24 with the self-generated airflow. The defibrated material that passes through the defibrating unit 20 is transmitted to the screening unit 40 via a pipe 3. Note that, as the air flow for causing the defibrated material to be transported from the defibrating unit 20 to the screening unit 40, an air flow generated by the defibrating unit 20 may be utilized, or an air flow generating device such as a blower may be provided, and an air flow generated therefrom may be used.

The screening unit 40 introduces a defibrated material defibrated by the defibrating unit 20 from the introduction port 42 and screens the material according to fiber length. The screening unit 40 includes a housing portion 43 accommodating a drum portion 41 and a drum portion 41. A sieve is used as the drum portion 41. The drum portion 41 includes a mesh (filter, screen) and is able to divide fibers or particles (first screened material passing through the mesh) that are smaller than the size of the openings of the mesh and included and fibers, non-defibrated pieces or lumps (second screened material not passing through the mesh) larger than the size of the opening in the mesh. For example, the first screened material is transmitted to the mixing unit 50 via the pipe 7. The second screened material is returned to the defibrating unit 20 from the exit port 44 via the pipe 8. Specifically, the drum portion 41 is a cylindrical sieve that is able to rotatably driven by a motor. A metal mesh, an expanded metal in which a perforated metal plate is drawn, and a punched metal plate in which holes are formed in a metal plate by a pressing machine or the like are used as the mesh of the drum portion 41.

The first web forming unit 45 transports the first screened material passing through the screening unit 40 to the mixing unit 50. The first web forming unit 45 includes a mesh belt 46, a tensioned roller 47, and a suction unit (suction mechanism) 48.

It is possible for the suction unit 48 to suction the first screened material dispersed in the air after passing through the opening (opening of the mesh) of the screening unit 40 on the mesh belt 46. The first screened material is accumulated on the moving mesh belt 46 and forms the web V. The specific configurations of the mesh belt 46, the tensioned roller 47, and the suction unit 48 are the same as the mesh belt 72, the tensioned roller 74, and the suction mechanism 76 of the second web forming unit 70, described later.

The web V is formed in a state of including large volumes of air and being softly swelled by passing through the screening unit 40 and the first web forming unit 45. The web V accumulated on the mesh belt 46 is fed to the pipe 7 and transported to the mixing unit 50.

The rotating body 49 can cut the web V before transporting the web V to the mixing unit 50. In the examples of the drawings, the rotating body 49 includes a base portion 49*a* and a projection 49*b* projecting from the base portion 49*a*. The projection 49*b* has a plate shape, for example. In the examples of the drawings, four projections 49*b* are provided, and the four projections 49*b* are provided at even intervals. When the base portion 49*a* is rotated in a direction R, the projection 49*b* can make the base portion 49*a* rotated as an axis. When the web V is cut by the rotating body 49, for example, it is possible to reduce fluctuation in the amount of defibrated material per unit time supplied to the accumulation unit 60.

The rotating body 49 is provided in the vicinity of the first web forming unit 45. In the examples of the drawings, the rotating body 49 is provided in the vicinity of (beside the tensioned roller 47*a*) the tensioned roller 47*a* positioned on the downstream side in the path of the web V. The rotating body 49 is provided at a position where the projection 49*b* is in contact with the web V and is not in contact with the mesh belt 46 on which the web V is accumulated. With this, it is possible to suppress the mesh belt 46 from being worn (damaged) by the projection 49*b*. The shortest distance between the projection 49*b* and the mesh belt 46 is, for example, in a range of 0.05 mm to 0.5 mm.

The mixing unit 50 mixes the first screened material (first screened material transported by the first web forming unit 45) passing through the screening unit 40 and the additive agent that includes a resin. The mixing unit 50 includes an additive agent supplying unit 52 that supplies the additive agent, a pipe 54 that transports the first screened material and the additive agent, and a blower 56. In the examples in the drawings, the additive agent is supplied from the additive agent supplying unit 52 to the pipe 54 via the hopper 9. The pipe 54 is contiguous with the pipe 7.

An airflow is generated by the blower 56 in the mixing unit 50, and it is possible to transport the first screened material and the additive agent while being mixed in the pipe 54. The mechanism by which the first screened material and the additive agent are mixed is not particularly limited, and may be a mechanism that performs stirring with blades that rotate at high speed, or may be a mechanism that uses the rotation of a container such as a V-type mixer.

A screw feeder as shown in FIG. 1, a disk feeder, not shown, or the like is used as the additive agent supplying unit 52. The additive agent supplied from the additive agent supplying unit 52 includes a resin for causing the plurality of fibers to bond. At the point in time at which the resin is supplied, the plurality of fibers is not bonded. The resin is fused when passing through the sheet forming unit 80 and the plurality of fibers is bonded.

The resin supplied from the additive agent supplying unit 52 is a thermoplastic resin or a heat-curable resin, and is an AS resin, an ABS resin, polypropylene, polyethylene, polyvinyl chloride, polystyrene, an acrylic resin, a polyester resin, polyethylene terephthalate, polyphenylene ether, polybutylene terephthalate, nylon, polyamide, polycarbonate, polyacetal, polyphenylene sulfide, polyetherether ketone, or the like. These resins may be used independently or mixed, as appropriate. The additive agent supplied from the additive agent supplying unit 52 may be in the form of a fiber, or may be in the form of a powder.

The additive agent supplied from the additive agent supplying unit 52 may include, according to the type of sheet manufactured, coloring agents for coloring the fibers, coagulation inhibitors for preventing aggregation of the fibers, and flame retardants for making the fibers and the like more difficult to burn, in addition to the resin that bonds the fibers. The mixture (mixture of the first screened material and the additive agent) passing through the mixing unit 50 is transmitted to the accumulation unit 60 via the pipe 54.

The accumulation unit 60 accumulates a material (mixture) containing a fiber and a resin. The accumulation unit 60 introduces the mixture passing through the mixing unit 50 from the introduction port 62, refines the entangled defibrated material (fibers) and causes the defibrated material to descend while being dispersed in air. The accumulation unit 60 refines the entangled resin in a case where the resin of the additive agent supplied from the additive agent supplying unit 52 is in the form of a fiber. In so doing, it is possible for the accumulation unit 60 to cause the mixture to be uniformly accumulated on the second web forming unit 70.

The accumulation unit 60 includes a drum portion 61 and a housing portion 63 accommodating the drum portion 61. A cylindrical sieve that rotates is used as the drum portion 61. The drum portion 61 includes a mesh, and causes the fibers of particles (passing through the mesh) included in the mixture passing through the mixing unit 50 and smaller than the size of the mesh openings to descend. The configuration of the drum portion 61 is that same as the configuration of the drum portion 41.

The "sieve" of the drum portion 61 may not have a function of screening specified target materials. That is, the wording "sieve" used as the drum portion 61 signifies a sieve provided with a mesh, and the drum portion 61 may cause all of the mixture introduced to the drum portion 61 to descend.

The second web forming unit 70 accumulates the passing-through material passing through accumulation unit 60 and forms the web W. The second web forming unit 70 includes a mesh belt 72, a tensioned roller 74, and a suction mechanism 76.

The mesh belt 72 accumulates the passing-through material passing through the openings (openings of the mesh) of the accumulation unit 60 while moving. The mesh belt 72 has a configuration in which the mesh belt 72 is tensioned by the tensioned roller 74, and air that does not easily pass through the passing-through material passes therethrough. The mesh belt 72 moves through the tensioned roller 74 rotating. The web W is formed as a sediment on the mesh belt 72 by the passing-through material passing through the accumulation unit 60 continuously accumulating while the mesh belt 72 continuously moves. The mesh belt 72 is made from a metal, a resin, a fabric, a non-woven fabric or the like.

The suction mechanism 76 is provided below (opposite side to the accumulation unit 60 side) the mesh belt 72. It is possible for the suction mechanism 76 to cause a downward moving airflow (airflow from the accumulation unit 60 to mesh belt 72) to be generated. It is possible for the mixture dispersed in the air by the accumulation unit 60 to be suctioned onto the mesh belt 72 by the suction mechanism 76. In so doing, it is possible for the discharge speed from the accumulation unit 60 to be increased. It is possible to form a down flow in the dropping path of the mixture by the suction mechanism 76, and it is possible to avoid the defibrated material and the additive agent being entangled during dropping.

As above, the web W is formed in a state of including large volumes of air and being softly swelled by passing through the accumulation unit 60 and the second web forming unit 70 (web forming step). The web W accumulated on the mesh belt 72 is transported to the sheet forming unit 80.

In the examples in the drawings, a moisture-adjusting unit 78 that adjusts the moisture of the web W is provided. It is possible for the moisture-adjusting unit 78 to add water or water vapor to the web W and regulate the ratio of the web W to the water.

The sheet forming unit 80 forms the sheet S by pressurizing and heating the web W accumulated on the mesh belt 72. In the sheet forming unit 80, it is possible for the plurality of fibers in the mixture to be bonded to one another via the additive (resin) by applying heat to the mixture of the defibrated material and the additive agent mixed into the web W.

The sheet forming unit 80 is provided with a pressurizing unit 82 that pressurizes the web W, and a heating unit 84 that heats the web W pressurized by the pressurizing unit 82. The pressurizing unit 82 is constituted by a pair of calender rollers 85 and applies pressure to the web W. The web W has the thickness reduced (thinned) by being pressurized, and a density of the web W is increased. A heating roller (heater roller), a hot press molding machine, a hot plate, a hot air blower, an infrared heating device, or a flash fixing device is used as the heating unit 84.

In the examples in the drawings, the heating unit 84 is provided with a pair of heating rollers 86. It is possible to form a sheet S while continuously transporting the web W by configuring the heating unit 84 as heating rollers 86, compared to a case of configuring the heating unit 84 as a plate-like press device (plate press device). Here, the calender roller 85 (pressurizing unit 82) can apply a pressure that is higher than the pressure applied to the web W to the web W by the heating roller 86 (the heating unit 84). Note that, the number of the calender rollers 85 and the heating rollers 86 is not particularly limited.

The cutting unit 90 cut the sheet S formed by the sheet forming unit 80. In the examples in the drawings, the cutting unit 90 includes a first cutting unit 92 that cut the sheet S in a direction that intersects the transport direction of the sheet S and a second cutting unit 94 that cuts the sheet S in a direction parallel to the transport direction. The second cutting unit 94 cuts the sheet S passing through the first cutting unit 92.

As above, a cut-form sheet S with a predetermined size is formed. The cut-form sheet S that is cut is discharged to the discharge unit 96.

The sheet manufacturing apparatus 100 includes a controller 104 including a CPU and a storage unit (ROM, RAM). The controller 104 controls the rotation of the heating roller 86 by outputting a control signal to a driving unit (motor) which rotatably drives the heating roller 86 (the first rotating body and the second rotating body). In addition, the controller 104 controls the heating roller 86 to be displaced by outputting the control signal to the motor of the displacement mechanism for displacing the heating roller 86.

2. Configuration of Heating Unit

In the above-described sheet forming unit 80 (the heating unit 84), the sheet manufacturing apparatus 100 of the embodiment forms a sheet S by heating and pressurizing the web W (a sediment formed by the accumulation unit 60). In the example of FIG. 1, the heating unit 84 is drawn as a pair of heating rollers 86 in a simplified manner. Hereinafter, the heating unit 84 of the sheet manufacturing apparatus 100 of the embodiment will be described in detail.

Figure 2:
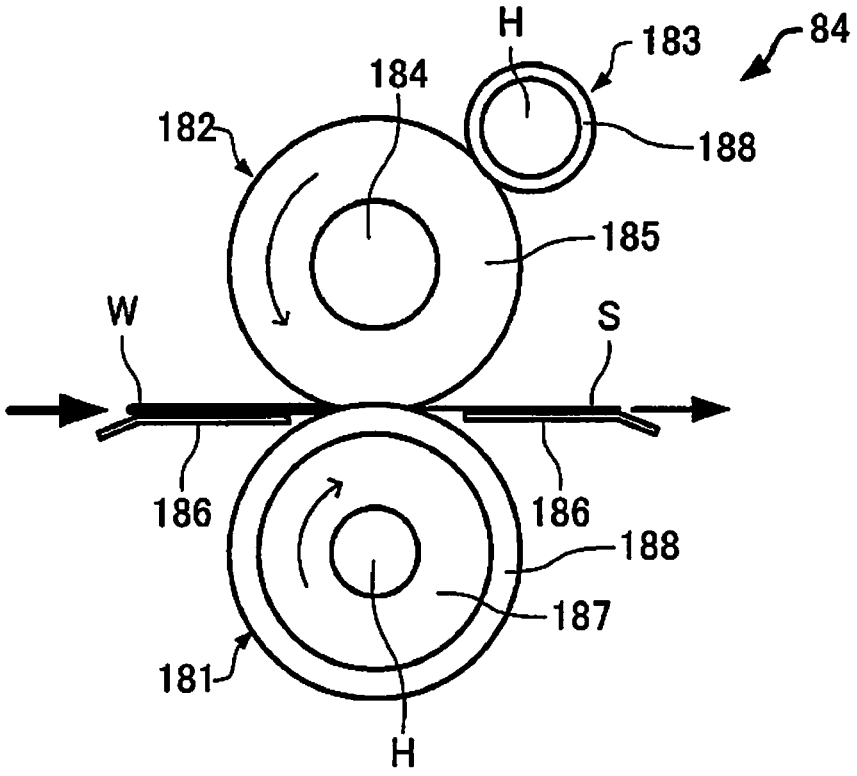
FIG. 2 is a diagram schematically illustrating an example of a heating unit (first position).
Figure 3:
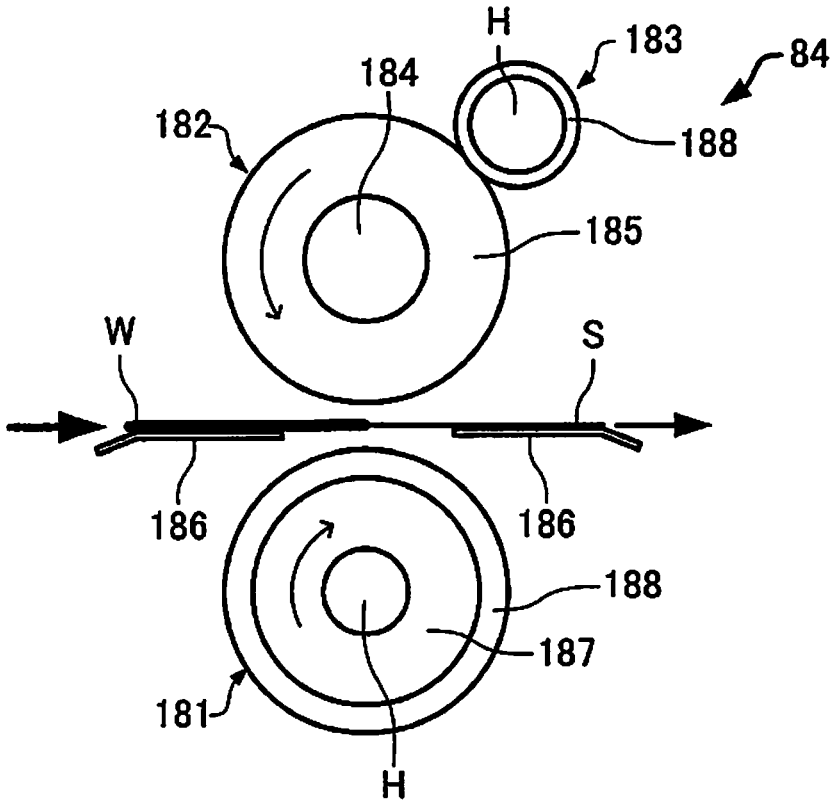
FIG. 3 is a diagram schematically illustrating an example of a heating unit (second position).

FIG. 2 and FIG. 3 are diagrams schematically illustrating an example of the heating unit 84 of the embodiment. The heating unit 84 includes a rotatable first rotating body 181, a rotatable second rotating body 182, and a heating body 183. Both of the first rotating body 181 and the second rotating body 182 have a roller shape having the outer circumferential surface which moves with rotation, and the web W is nipped, heated, and pressurized by the first rotating body 181 and the second rotating body 182 so as to form the sheet S. In addition, the heating body 183 is disposed so as to heat the outer circumferential surface of the second rotating body 182. Both of the first rotating body 181 and the heating body 183 are heating rollers having a heat source H (for example, a halogen heater) inside. Note that, instead of heating the second rotating body 182 by the heating body 183, a non-contact heater (for example, an infrared heater and a carbon heater) may be used to heat the second rotating body 182. The heating unit 84 includes a heat controller (not shown) that controls a heat source H and a temperature measurement unit (not shown) that detects the temperatures of the first rotating body 181 and the second rotating body 182. The controller 104 may have at least a part of the functions the heat controller and the temperature measurement unit.

The second rotating body 182 is configured to include a core bar 184 at the center of the rotation and a soft body 185 disposed so as to surround the periphery thereof. The core bar 184 is made of metal such as aluminum, iron, and stainless steel, and the soft body 185 is made of rubber such as silicone rubber and urethane rubber. Further, the first rotating body 181 and the heating body 183 are made of a metallic hollow core bar 187, and a releasing layer 188 of fluorine coating is provided on the surface thereof.

The heating unit 84 of the embodiment can be displaced to a first position (refer to FIG. 2) where the first rotating body 181 and the second rotating body 182 nips, heats, and pressurizes the web W, and a second position (refer to FIG. 3) where the first rotating body 181 and the second rotating body 182 are separated from each other. The sheet manufacturing apparatus 100 of the embodiment is provided with a displacement mechanism for displacing the position of the heating unit 84. The displacement mechanism may displace any one of the first rotating body 181 and the second rotating body 182, or may displace both of the first rotating body 181 and the second rotating body 182. Note that, as illustrated in FIGS. 2 and 3, the first rotating body 181 and the second rotating body 182 may not come in contact with the web W by providing the supporting unit 186 (guide) in the vicinity of the first rotating body 181 and the second rotating body 182 which nip the web W. Each of the supporting units 186 is provided at a position on the upstream side in the transport direction and a position on the downstream side in the transport direction of the web W with respect to a nipped portion of the first rotating body 181 and the second rotating body 182.

Figure 4A:
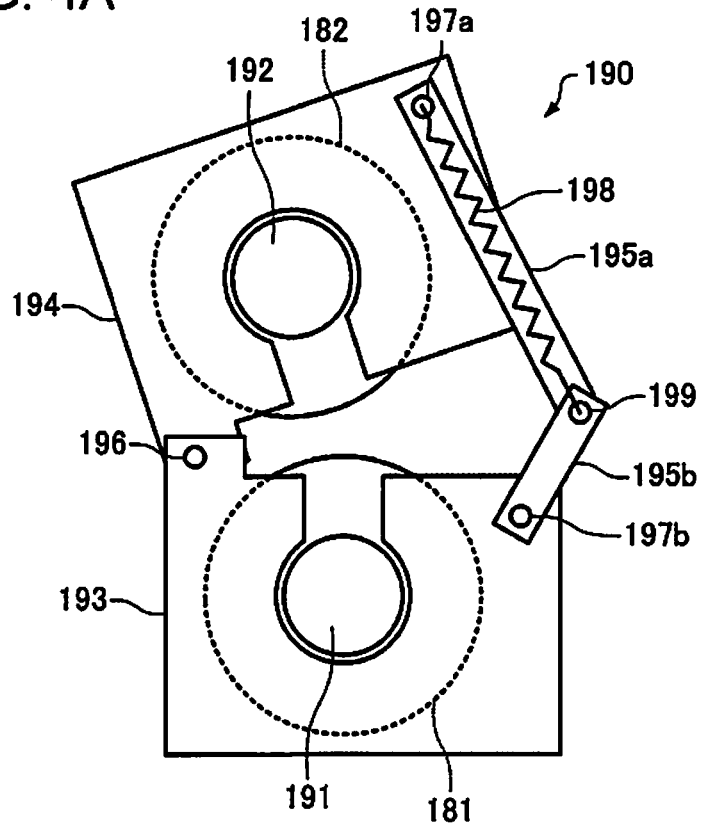
FIG. 4A is a diagram schematically illustrating an example in which a displacement mechanism is in the second position.
Figure 4B:
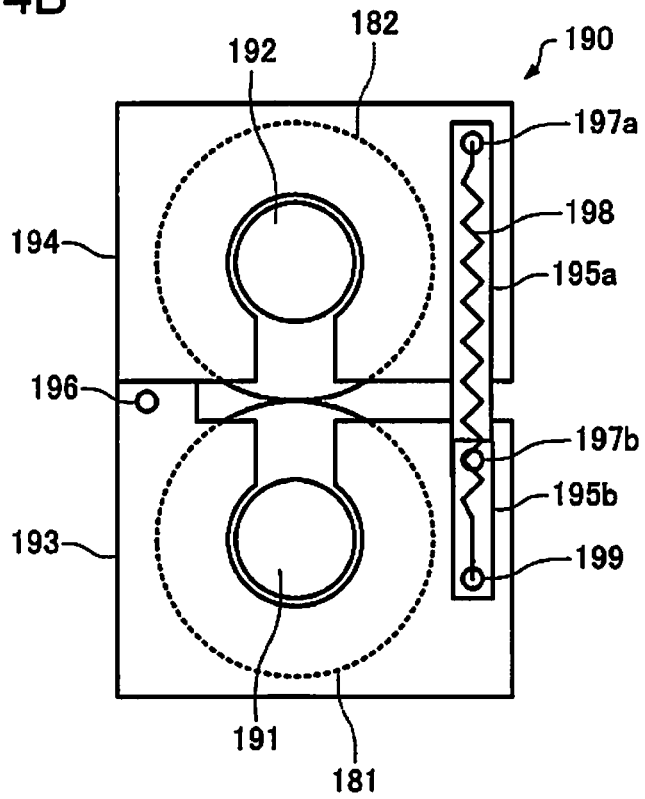
FIG. 4B is a diagram schematically illustrating an example in which a displacement mechanism is in the first position.

FIG. 4A and FIG. 4B are diagrams schematically illustrating an example of a displacement mechanism of the embodiment. The displacement mechanism 190 includes a first bearing portion 193 for rotatably supporting a rotation axis 191 of the first rotating body 181, a second bearing portion 194 that for rotatably supporting a rotation axis 192 of the second rotating body 182, a first rod 195*a*, and a second rod 195*b*. The first bearing portion 193 and the second bearing portion 194 are connected to each other so as to be rotated around the rotation axis 196. One end of the first rod 195*a* is provided in the second bearing portion 194 so as to be rotated around the rotation axis 197*a*, and one end of the second rod 195*b* is provided in the first bearing portion 193 so as to be rotated around the rotation axis 197*b*. A biasing member 198 (spring) is provided in the first rod 195*a*. One end of the biasing member 198 is connected to the rotation axis 197*a*, and the other end of the biasing member 198 is connected to the other end 199 of the second rod 195*b*. The displacement mechanism 190 includes a driving unit (not shown) that rotatably drives the second rod 195*b* around the rotation axis 197*b*.

FIG. 4A illustrates a state when the heating unit 84 is at the second position, and FIG. 4B illustrates a state when the heating unit 84 is at the first position. In the state (second position) illustrated in FIG. 4A, when the second rod 195*b* is rotated clockwise, as illustrated in FIG. 4B, the position is displaced to the first position where the first rotating body 181 and the second rotating body 182 come in contact with each other. At this time, by the biasing member 198, the first bearing portion 193 (the first rotating body 181) is biased toward the second bearing portion 194 (the second rotating body 182), and the second bearing portion 194 is biased toward the first bearing portion 193. In addition, in the state (the first position) illustrated in FIG. 4B, when the second rod 195*b* is rotated counterclockwise, the position is displaced to the second position where the first rotating body 181 and the second rotating body 182 are separated from each other.

The heating unit 84 of the embodiment is configured such that each of the first rotating body 181 and the second rotating body 182 is rotatably driven in the second position. The sheet manufacturing apparatus 100 of the embodiment is provided with a driving unit 201 that rotatably drives the first rotating body 181, and a transmission mechanism 200 that transmits the driving force of the driving unit 201 to the second rotating body 182 in the second position without transmitting the driving force of the driving unit 201 to the second rotating body 182 in the first position.

Figure 5A:
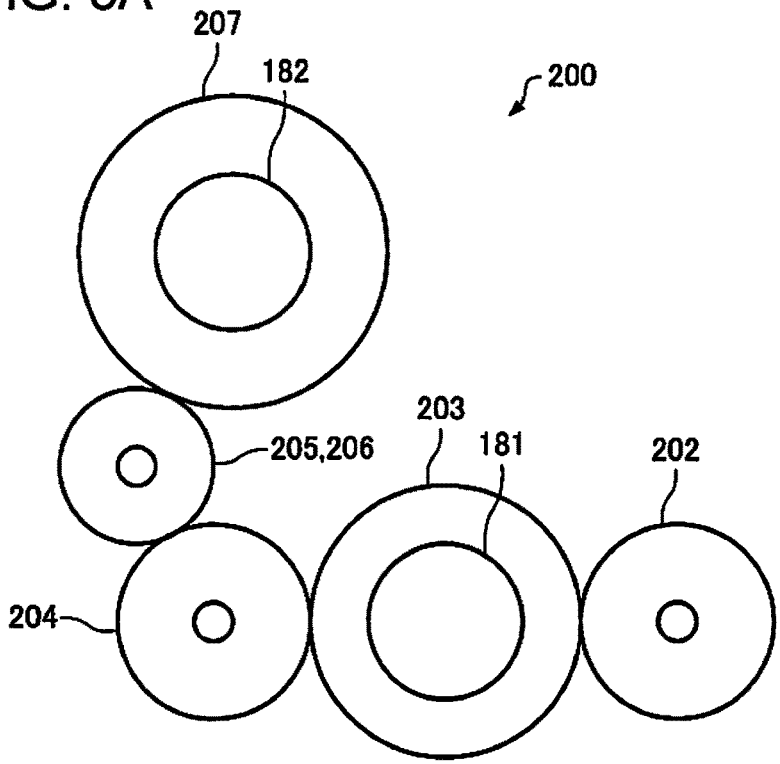
FIG. 5A is a diagram schematically illustrating an example of a transmission mechanism.
Figure 5B:
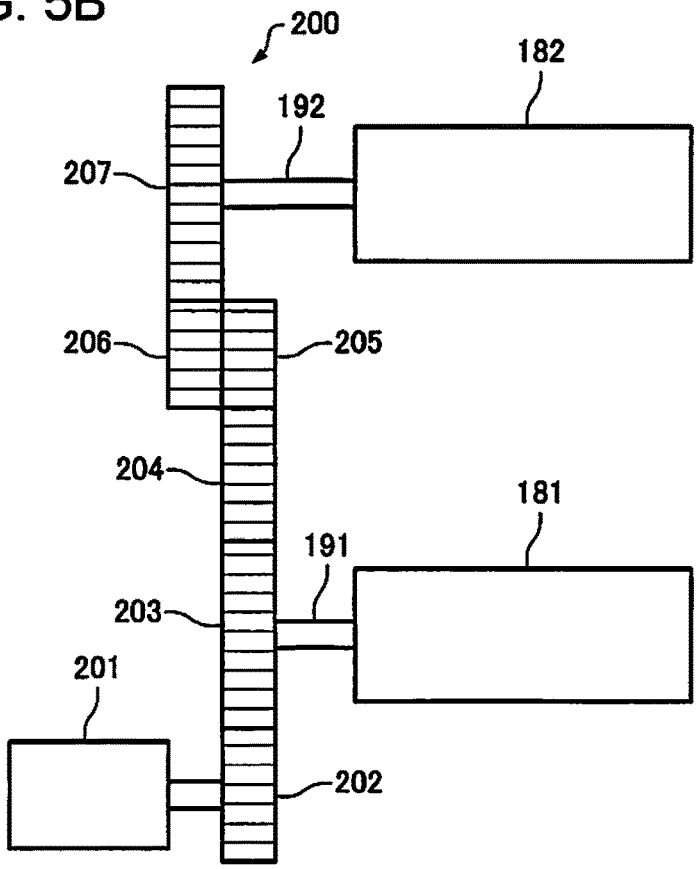
FIG. 5B is a diagram schematically illustrating an example of a transmission mechanism.

FIG. 5A and FIG. 5B are diagrams schematically illustrating an example of a transmission mechanism of the embodiment. A transmission mechanism 200 includes a drive gear 202, a main gear 203, a first gear 204, a second gear 205, a third gear 206, and a fourth gear 207. The drive gear 202 is connected to the rotation axis of the driving unit 201 (the driving unit that rotatably drives the first rotating body 181). The main gear 203 meshes with the drive gear 202, and a rotation axis 191 of the first rotating body 181 is connected to the main gear 203. In addition, the first gear 204 meshes with the main gear 203, and the second gear 205 meshes with the first gear 204. The third gear 206 is connected to the rotation axis of the second gear 205 via a one-way clutch (not shown). The fourth gear 207 meshes with the third gear 206, and the rotation axis 192 is connected to the second rotating body 182 of the fourth gear 207.

When the second rotating body 182 comes in contact with the first rotating body 181 (in the second position), the second rotating body 182 is rotatably driven with the driving force transmitted by the transmission mechanism 200. Here, the transmission mechanism 200 is configured such that the peripheral speed of the first rotating body 181 and the peripheral speed of the second rotating body 182 are different from each other, and in the second position, the second rotating body 182 is rotated at a peripheral speed slower than the peripheral speed of the first rotating body 181. Here the peripheral speed of the second rotating body 182 is delayed by about 10% from the peripheral speed of the first rotating body 181.

When the second rotating body 182 comes in contact with the first rotating body 181 (when the position is displaced to the first position where the first rotating body 181 and the second rotating body 182 nip web W), the peripheral speed of the second rotating body 182 rotated with the driving force transmitted by the transmission mechanism 200 is slower than the peripheral speed of the first rotating body 181, the third gear 206 which is a one-way gear idles and the second rotating body 182 Is driven to rotate by friction with the outer circumferential surface of the first rotating body 181 (the surface of the web W that is nipping). That is, in the first position, the driving force of the driving unit 201 is not transmitted to the second rotating body 182, and the second rotating body 182 is driven in accordance with the first rotating body 181. Note that, in consideration that the peripheral speed of the second rotating body 182 formed of the soft body 185 is increased due to thermal expansion, the transmission mechanism 200 is configured such that the peripheral speed of the second rotating body 182 is slower than the peripheral speed of the first rotating body 181.

Figure 6:
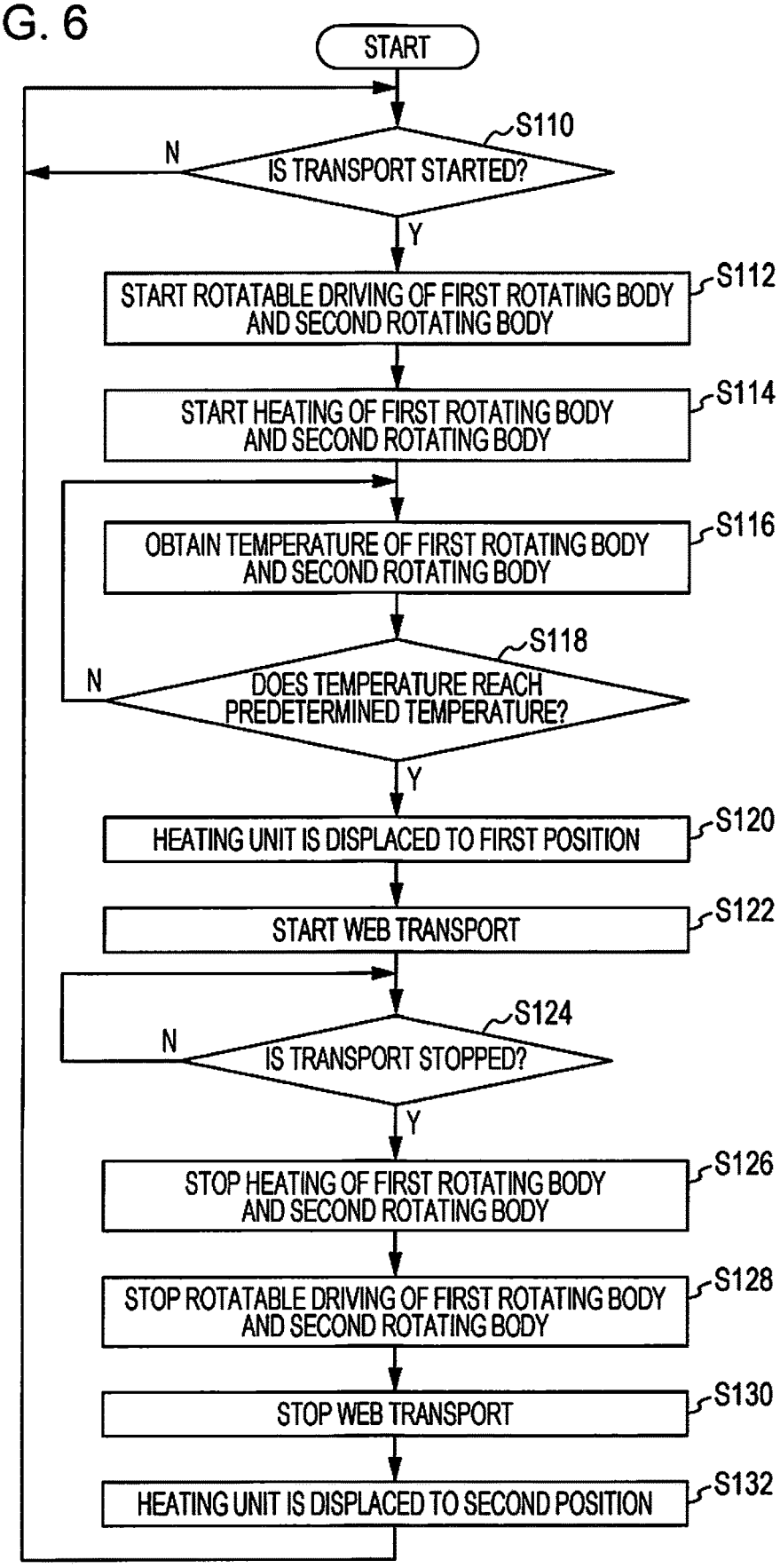
FIG. 6 is a flow chart illustrating an example of a process of a controller.

FIG. 6 is a flow chart illustrating an example of a process of the controller 104. First, the controller 104 determines whether or not the transport of the web W is started (step S110). At this time, the heating unit 84 is in the second position where the first rotating body 181 and the second rotating body 182 are separated from each other. In a case where it is determined that the transport of the web W is started in step S110 (for example, in a case where a use performs an operation for starting the manufacturing of the sheet, the controller 104 transmits a control signal to the driving unit 201 so as to perform control to start rotation driving of the first rotating body 181 and the second rotating body 182 (step S112). Next, the controller 104 transmits the control signal to the heat controller so as to perform control to start heating of the first rotating body 181 and the second rotating body 182 (step S114).

Next, the controller 104 obtains the temperature of the heating unit 84 (the temperature of the first rotating body 181 and the second rotating body 182) from the temperature measurement unit (step S116), and determines whether or not the obtained temperature reaches a predetermined temperature (step S118). Here, "the temperature of the heating unit 84 reaches a predetermined temperature" means that the temperature of the first rotating body 181 reaches a predetermined first temperature, and the temperature of the second rotating body 182 reaches a predetermined second temperature. The first temperature and the second temperature may be the same temperature or different temperature. In a case where the temperature of the heating unit 84 does not reach a predetermined temperature (N in step S118), the process proceeds to step S116, and in a case where the temperature of the heating unit 84 reaches a predetermined temperature (Y in step S118), the controller 104 transmits the control signal to the driving unit of the displacement mechanism 190 so as to control the heating unit 84 to be displaced to the first position where the first rotating body 181 and the second rotating body 182 nip the web W (step S120). At this time, the position may be displaced to the first position in the state where the first rotating body 181 and the second rotating body 182 are rotated, or the position may be displaced to the first position after stopping the rotation of the first rotating body 181 and the second rotating body 182, and after the displacement to the first position, the rotation of the first rotating body 181 and the second rotating body 182 may be started again. At substantially the same time as step S120, the transport of the web W is started (step S122). For example, the mesh belt 72 (the tensioned roller 74), the pressurizing unit 82 (the calender roller 85), the heating unit 84 (the first rotating body 181 and the second rotating body 182), and the like are driven so as to start transporting the web W. Note that, the controller 104 controls the heat controller such that the temperature of the heating unit 84 is maintained to be a predetermined temperature.

First, the controller 104 determines whether or not the transporting of the web W is stopped (step S124). In a case where it is determined that the transporting of the web W is stopped in step S124 (for example, in a case where the user performs an operation for stopping the manufacturing of the sheet), the controller 104 transmits the control signal to the heat controller so as to perform control to stop heating the first rotating body 181 and the second rotating body 182 (step S126), and transmits the control signal to the driving unit 201 so as to perform control to stop rotation driving of the first rotating body 181 and the second rotating body 182 (step S128). At substantially the same time as step S128, the transport of the web W is stopped (step S130). For example, the driving of the mesh belt 72 (the tensioned roller 74), the pressurizing unit 82 (the calender roller 85), the heating unit 84 (the first rotating body 181 and the second rotating body 182), and the like is stopped so as to stop transporting the web W. Next, the controller 104 transmits the control signal to the driving unit of the displacement mechanism 190 so as to control the heating unit 84 to be displaced to the second position (step S132). Note that, the above-described process procedure is merely an example and may be changed as appropriate. For example, the process of step S114 may be performed before the process of step S112, or both may be performed at the same time. Further, the process of step S128 may be performed before the process of step S126, or both may be performed at the same time.

In this manner, in the sheet manufacturing apparatus 100 of the embodiment, at the time of starting the transport of web W, the heating unit 84 is heated in the second position where the first rotating body 181 and the second rotating body 182 are separated from each other, the temperature of the heating unit 84 reaches a predetermined temperature, and then the position of the heating unit 84 is displaced to the first position (heating is performed by nipping the web W by the first rotating body 181 and the second rotating body 182), and thereby it is possible to prevent the strength of the sheet from being partially lowered due to insufficient heating at the start of transport, and to make the strength of the sheet uniform.

In addition, in the sheet manufacturing apparatus 100 of the embodiment, the first rotating body 181 and the second rotating body 182 are heated while being rotated in the second position, and thereby it is possible to make the surface temperature of the first rotating body 181 and the second rotating body 182 uniform in the circumferential direction. If heating is performed in a state where the second rotating body 182 is stopped, only a portion in contact with the heating body 183 is heated, and thereby it is not possible to make the surface temperature of the second rotating body 182 uniform in the circumferential direction. Further, if heating is performed in a state where the first rotating body 181 is stopped, the heat from the heat source H is unevenly transmitted due to the influence of convection or the like, and thereby it is not possible to make the surface temperature of the first rotating body 181 in the circumferential direction.

Further, in the sheet manufacturing apparatus 100 of the embodiment, when the transport of the sediment is stopped, the position of the heating unit 84 is displaced from the first position to the second position, and thereby it is possible to suppress discoloration or the like of the web W by continuously nipping the web W between the first rotating body 181 and the second rotating body 182 (excessive heating at the time of stopping the transport) at the time of stopping the transport. Further, when the first rotating body 181 and the second rotating body 182 do not come in contact with the web W in the second position by the supporting unit 186 or the like, it is possible to reliably prevent discoloration or the like of the web W.

In addition, in the sheet manufacturing apparatus 100 of the embodiment, when the transmission mechanism 200 is configured such that the driving force of the driving unit 201 is not transmitted to the second rotating body 182 in the first position, the second rotating body 182 can be driven in accordance with the first rotating body 181 in the first position, and thereby it is possible to stably transport the web W by the first rotating body 181 and the second rotating body 182. If the driving force of the driving unit 201 is transmitted to the second rotating body 182 even in the first position, due to a difference in the peripheral speed between the first rotating body 181 and the second rotating body 182 (a speed difference due to thermal expansion of the second rotating body 182, a speed difference due to part tolerance), it is not possible to stably transport the web W. In addition, if the first position is assumed to be displaced in a state where any one of the first rotating body 181 and the second rotating body 182 is rotated, an impact is applied to the web W when the first rotating body 181 and the second rotating body 182 nip the web W, and thereby the quality of the sheet is deteriorated.

Second Embodiment

Hereinafter, the second embodiment of the invention will be described. In the embodiment, the same reference numerals are given to the same constituent members as those of the first embodiment, and the description thereof will be not be repeated or simplified.

Figure 7:
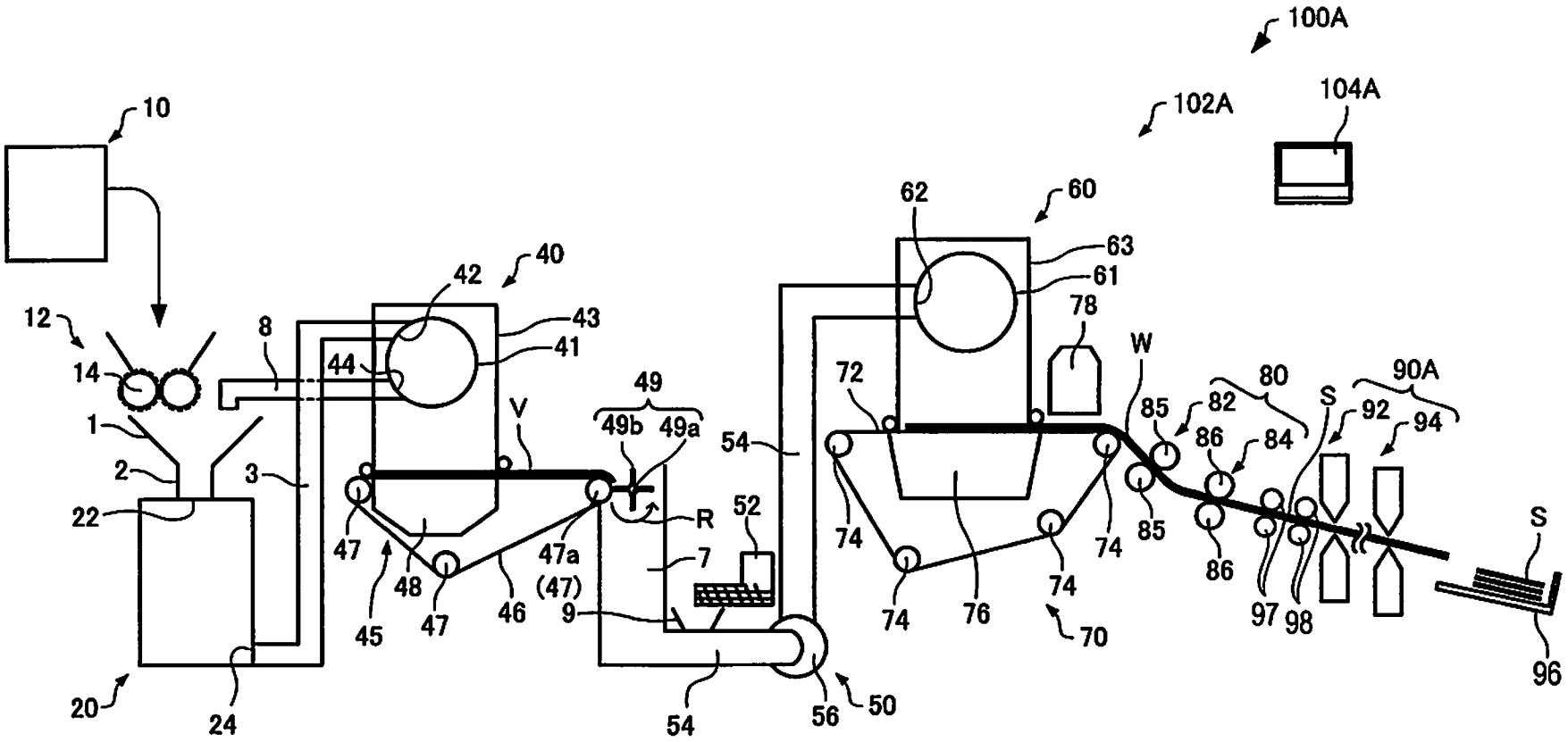
FIG. 7 is a schematic view illustrating a configuration of a sheet manufacturing apparatus according to a second embodiment.

First, the configuration of a sheet manufacturing apparatus 100A of the embodiment will be described in detail. FIG. 7 is a schematic view illustrating a configuration of the sheet manufacturing apparatus according to the embodiment.

As illustrated in FIG. 7, the sheet manufacturing apparatus 100A is provided with a supplying unit 10, a manufacturing unit 102A, and a controller 104A. The manufacturing unit 102A manufactures a sheet. The manufacturing unit 102A includes a crushing unit 12, a defibrating unit 20, a screening unit 40, a first web forming unit 45, a rotating body 49, a mixing unit 50, an accumulation unit 60, a second web forming unit 70, a sheet forming unit 80, and a cutting unit 90A.

The supplying unit 10, the crushing unit 12, the defibrating unit 20, the screening unit 40, the first web forming unit 45, the rotating body 49, the mixing unit 50, the accumulation unit 60, the second web forming unit 70, and the sheet forming unit 80 of the embodiment are the same configuration members as those of the first embodiment, and thus the description thereof will not be repeated.

The cutting unit 90A cut the sheet S formed by the sheet forming unit 80. In the examples in the drawings, the cutting unit 90A includes a first cutting unit 92 that cut the sheet S in a direction that intersects the transport direction of the sheet S and a second cutting unit 94 that cuts the sheet S in a direction parallel to the transport direction. The second cutting unit 94 cuts the sheet S passing through the first cutting unit 92. Note that, transport roller pairs 97 and 98 including driving rollers that can transport the sheet S are disposed on the upstream side of the first cutting unit 92 in the transport direction.

As above, a cut-form sheet S with a predetermined size is formed. The cut-form sheet S that is cut is discharged to the discharge unit 96.

Next, the configuration of the heating unit will be described. The sheet manufacturing apparatus 100A of the embodiment forms the sheet S by heating and pressurizing the web W (the sediment formed by the accumulation unit 60) in the above-described sheet forming unit 80 (the heating unit 84). In the example of FIG. 7, the heating unit 84 is drawn as a pair of heating rollers 86 in a simplified manner. Hereinafter, the heating unit 84 of the sheet manufacturing apparatus 100A of the embodiment will be described in detail.

Figure 8:
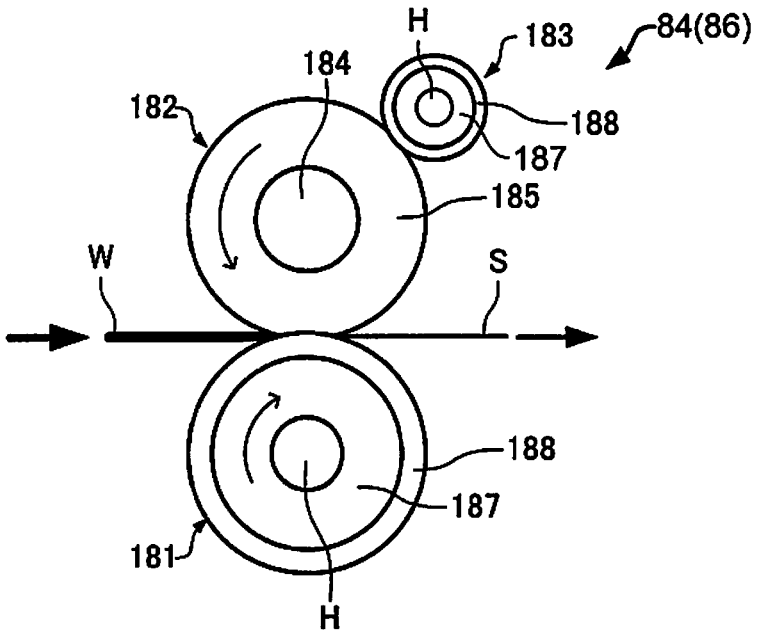
FIG. 8 is a schematic view illustrating a configuration of a heating unit according to the second embodiment.
Figure 9:
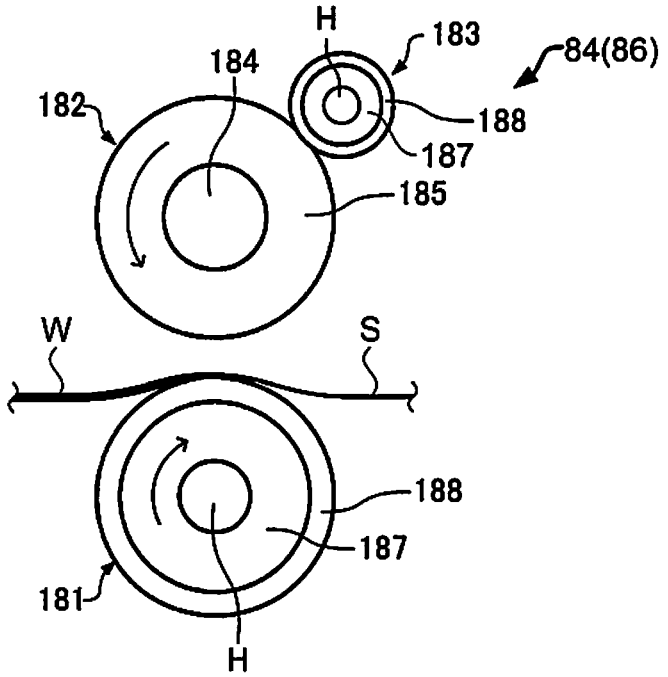
FIG. 9 is a schematic view illustrating a configuration of a heating unit according to the second embodiment.

FIG. 8 and FIG. 9 are schematic views illustrating the configuration of the heating unit of the embodiment. As illustrated in FIG. 8, the heating unit 84 (a pair of the heating rollers 86) includes a rotatable first rotating body 181, a rotatable second rotating body 182, and the heating body 183. Both of the first rotating body 181 and the second rotating body 182 have a roller shape having the outer circumferential surface which moves with rotation, and the web W is nipped, heated, and pressurized by the first rotating body 181 and the second rotating body 182 so as to form the sheet S. In addition, the heating body 183 is disposed so as to heat the outer circumferential surface of the second rotating body 182. Both of the first rotating body 181 and the heating body 183 have the heat source H (for example, a halogen heater) inside. Note that, instead of heating the second rotating body 182 by the heating body 183, a non-contact heater (for example, an infrared heater and a carbon heater) may be used to heat the second rotating body 182.

The second rotating body 182 is configured to include a core bar 184 at the center of the rotation and a soft body 185 disposed so as to surround the periphery thereof. The core bar 184 is made of metal such as aluminum, iron, and stainless steel, and the soft body 185 is made of rubber such as silicone rubber and urethane rubber. Further, the first rotating body 181 and the heating body 183 are made of a metallic hollow core bar 187, and a releasing layer 188 of fluorine coating is provided on the surface thereof.

Further, the heating unit 84 of the embodiment can be displaced to a first position (refer to FIG. 8) where the first rotating body 181 and the second rotating body 182 sandwiches, heats, and pressurizes the web W, and a second position (refer to FIG. 9) where the first rotating body 181 and the second rotating body 182 are separated from each other. In the embodiment, as illustrated in FIG. 9, the web W (the sheet S) is loosened in the direction of gravity in the second position where the first rotating body 181 and the second rotating body 182 are separated from each other, so that the web W comes into contact with the top portion of the first rotating body 181. In other words, the first rotating body 181 is a rotating body on the side being contact with the web W (the sheet S) in the second position where the first rotating body 181 and the second rotating body 182 are separated from each other.

The sheet manufacturing apparatus 100A of the embodiment is provided with a displacement mechanism 190 for displacing the position of the heating unit 84 to the first position and the second position. Since the displacement mechanism 190 has the same configuration as that in the first embodiment, the description thereof will not be repeated. The displacement mechanism 190 of the embodiment is configured such that the second rotating body 182 can be displaced with respect to the first rotating body 181.

In addition, the first rotating body 181 on the side being in contact with at least the web W can be rotated in the second position where the first rotating body 181 and the second rotating body 182 are separated from each other. Note that, in the embodiment, in the case where the heating unit 84 is in the second position, each of the first rotating body 181 and the second rotating body 182 can be rotatably driven. The sheet manufacturing apparatus 100A of the embodiment is provided with a driving unit 201 that rotatably drives the first rotating body 181, and a transmission mechanism 200 that transmits the driving force of the driving unit 201 to the second rotating body 182 in the second position without transmitting the driving force of the driving unit 201 to the second rotating body 182 in the first position. Since the transmission mechanism 200 has the same configuration as that in the first embodiment, the description thereof will not be repeated.

As the sheet manufacturing apparatus 100A of the embodiment, when the transmission mechanism 200 is configured such that the driving force of the driving unit 201 is not transmitted to the second rotating body 182 in the first position, the second rotating body 182 can be driven in accordance with the first rotating body 181 in the first position, and thereby it is possible to stably transport the web W by the first rotating body 181 and the second rotating body 182.

Note that, if the driving force of the driving unit 201 is transmitted to the second rotating body 182 even in the first position, due to a difference in the peripheral speed between the first rotating body 181 and the second rotating body 182 (a speed difference due to thermal expansion of the second rotating body 182, a speed difference due to part tolerance), it is not possible to stably transport the web W. In addition, if the first position is assumed to be displaced in a state where any one of the first rotating body 181 and the second rotating body 182 is rotated, an impact is applied to the web W when the first rotating body 181 and the second rotating body 182 nip the web W, and thereby the quality of the sheet is deteriorated.

Figure 10:
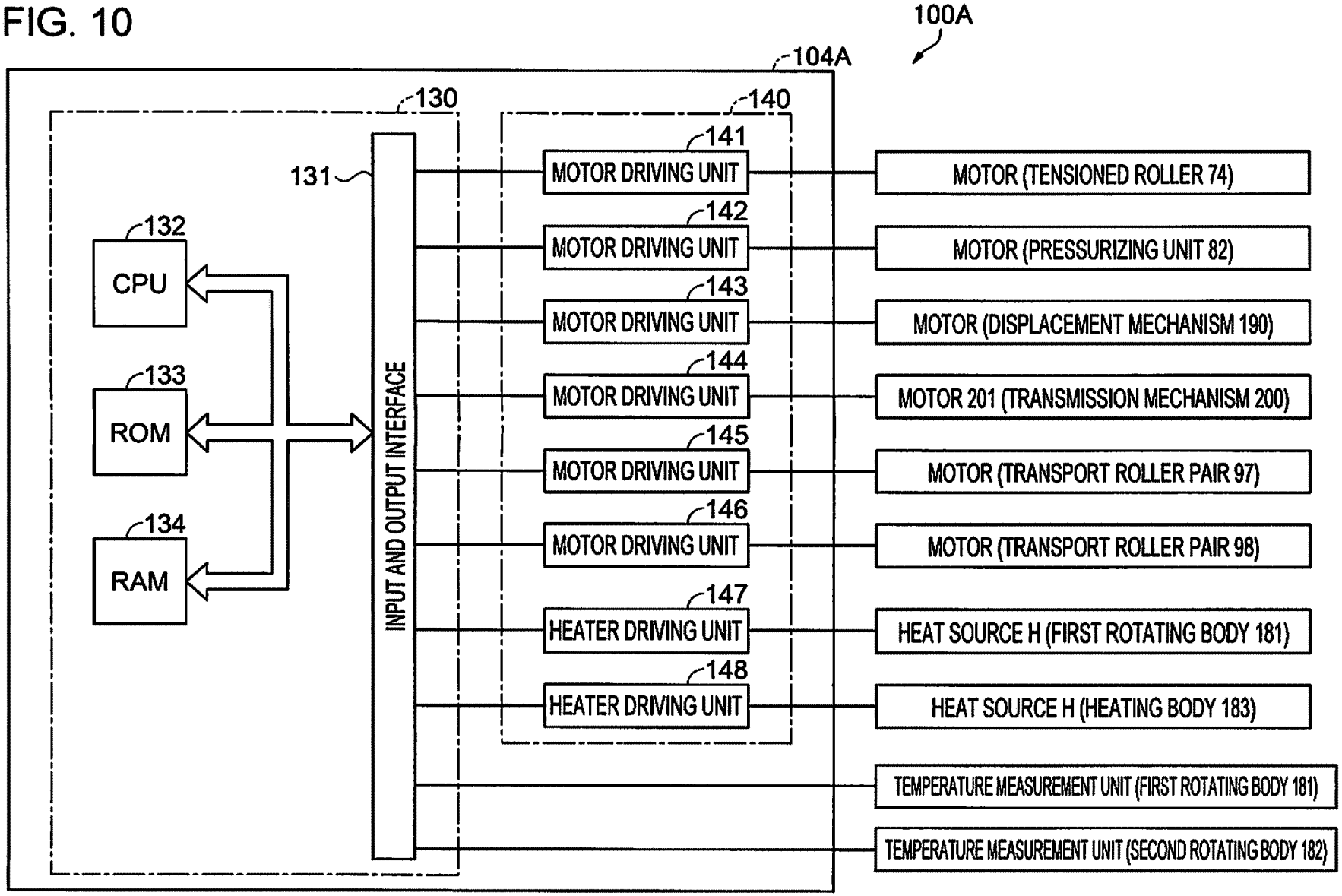
FIG. 10 is a block diagram illustrating a configuration of the controller of the sheet manufacturing apparatus according to the second embodiment.

Next, the configuration of the controller of the sheet manufacturing apparatus will be described. Note that, in the embodiment, the configurations of the heating unit and the controller around the periphery of the heating unit will be mainly described. FIG. 10 is a block diagram illustrating a configuration of the controller of the sheet manufacturing apparatus according to the embodiment. As illustrated in FIG. 10, a controller 104A is provided with a command unit 130 and a driver 140. The command unit 130 is provided with a CPU 132, a ROM 133 and a RAM 134 as a storage means, and an input and output interface 131, and the CPU 132 processes various types of signals input by via the input and output interface 131 based on the data of the ROM 133 and the RAM 134, and then outputs the control signal to the driver 140 via the input and output interface 131. The CPU 132 performs various types of controls based on a driving program stored in the ROM 133.

The driver 140 is configured to include motor driving units 141, 142, 143, 144, 145, and 146 corresponding to each motor, and heater driving units 147 and 148 corresponding to each heater. Further, the motor driving unit 141 controls the driving of the motor applied to the tensioned roller 74 based on the control signal of the command unit 130. The motor driving unit 142 controls the driving of the motor applied to the pressurizing unit 82. Further, the motor driving unit 143 controls the driving of the motor applied to the displacement mechanism 190. Further, the motor driving unit 144 controls the driving of the driving unit (motor) 201 applied to the transmission mechanism 200. The motor driving unit 145 controls the driving of the motor applied to the transport roller pair 97. The motor driving unit 146 controls the driving of the motor applied to the transport roller pair 98. In addition, the heater driving unit 147 controls the driving of the heat source H applied to the first rotating body 181, and the heater driving unit 148 controls the driving of the heat source H applied to the heating body 183.

In addition, each of the temperature measurement unit that detects the temperature of the first rotating body 181 and the temperature measurement unit that detects the temperature of the second rotating body 182 is connected to the command unit 130.

Figure 11:
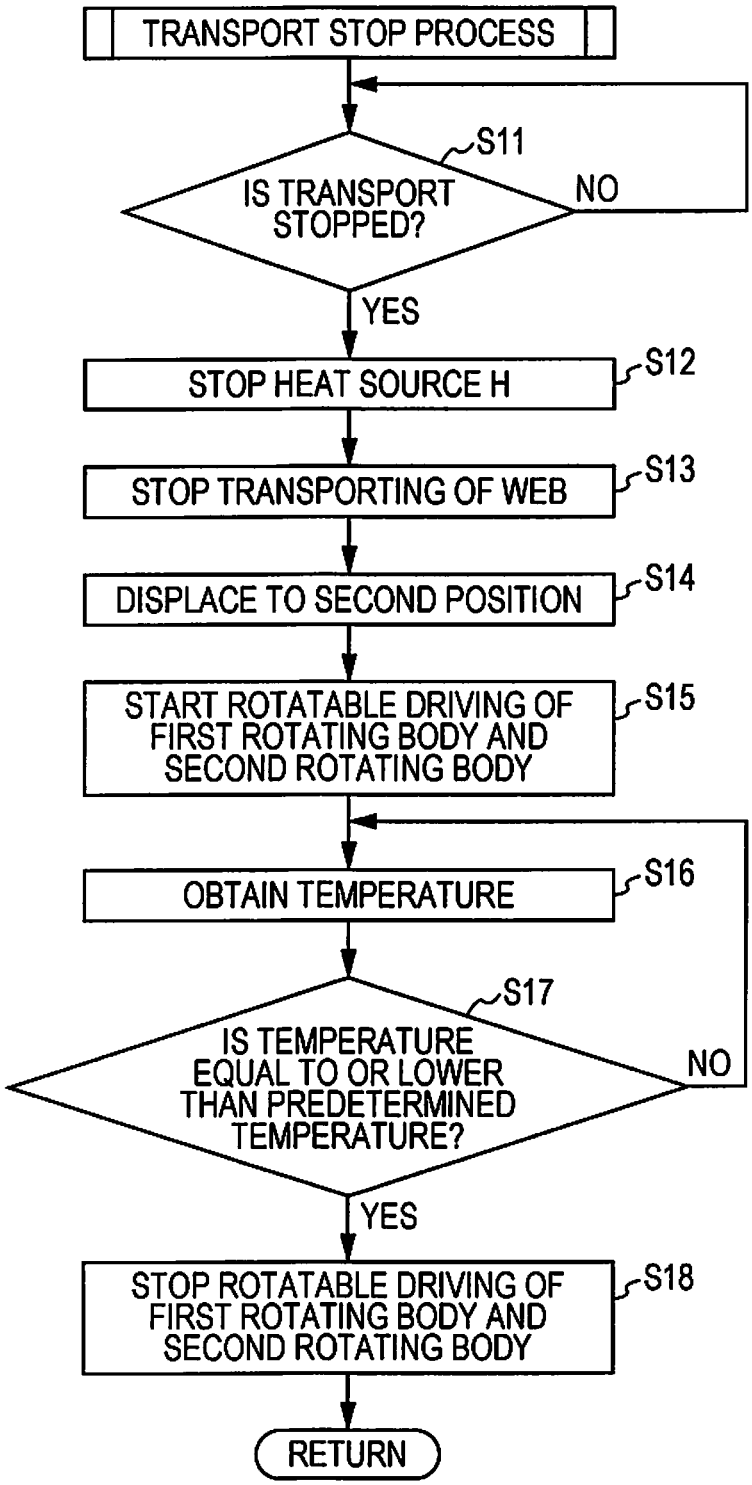
FIG. 11 is a flow chart illustrating a method of controlling the sheet manufacturing apparatus according to the second embodiment.
Figure 12:
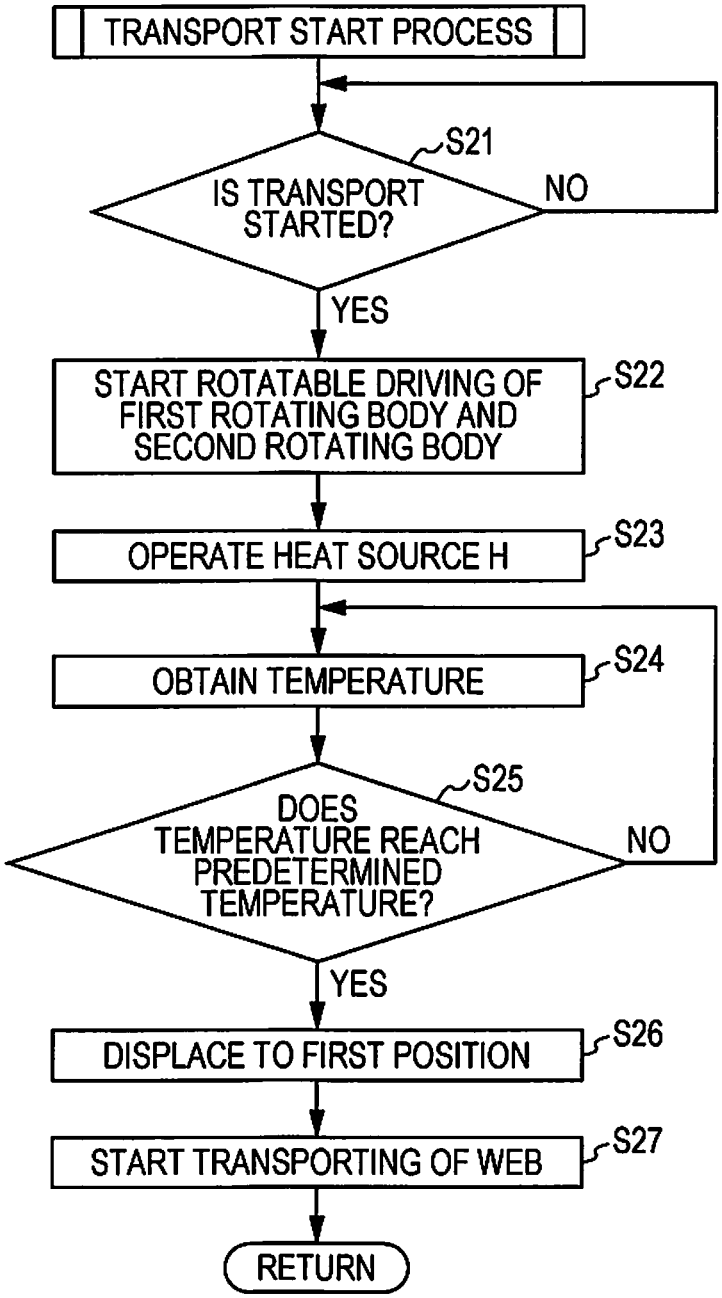
FIG. 12 is a flow chart illustrating a method of controlling the sheet manufacturing apparatus according to the second embodiment.

Next, a method of controlling the sheet manufacturing apparatus will be described. Note that, in the embodiment, the configurations of the heating unit and the controlling method around the periphery of the heating unit will be mainly described. FIG. 11 and FIG. 12 are flow charts illustrating a method of controlling the sheet manufacturing apparatus according to the embodiment. Specifically, FIG. 11 is a flow chart illustrating the control method in the case where the transport of the web W is stopped in the sheet manufacturing apparatus (transport stop process), and FIG. 12 is a flow chart illustrating the control method in the case where the transport of the web W is started in the sheet manufacturing apparatus (transport start process).

First, the transport stop process will be described.

As illustrated in FIG. 11, it is determined whether or not the transporting of the web W is stopped in step S11. In the case where it is determined that the transporting of the web W is stopped in step S11, for example, in the case where the user performs an operation for stopping the manufacturing of the sheet (YES), the process proceeds to step S12. On the other hand, in the case where the transporting of the web W is not stopped (NO), the process proceeds to step S11.

In a case where the process proceeds to step S12, the operation of the heat source H is stopped. Specifically, the operations of the heat source H of the first rotating body 181 and the heat source H of the heating body 183 for heating the second rotating body 182 are stopped by transmitting the control signal.

Subsequently, the transporting of the web W (sediment) is stopped in step S13. Specifically, the tensioned roller 74, the pressurizing unit 82 (the calender roller 85), the heating unit 84 (the first rotating body 181 and the second rotating body 182), the transport roller pairs 97 and 98, and the like are sopped by transmitting the control signal. With this, the transporting of the web W is stopped.

Next, in step S14, the position of the heating unit 84 is displaced from the first position to the second position. That is, when the transporting of the web W is stopped, the heating unit 84 is positioned in the second position. Specifically, the position of the heating unit 84 is displaced to the second position by transmitting the control signal to the motor applied to the displacement mechanism 190. With this, a state (the first position) where the web W is nipped by the first rotating body 181 and the second rotating body 182 of the heating unit 84 is changed to a state (the second position) where the first rotating body 181 and the second rotating body 182 are separated from each other. Note that, at this time, the pressurizing unit 82 (the calender roller 85), and the transport roller pairs 97 and 98 are in the state where the driving is stopped. That is, the pressurizing unit 82 (the calender roller 85) pressurizes (nips) the web W, and the transport roller pairs 97 and 98 are held in the state of pressurizing (nipping) the sheet S.

Next, the first rotating body 181 and the second rotating body 182 are rotatably driven in step S15. Specifically, the transmission mechanism 200 is driven by transmitting the control signal to the driving unit 201. With this, the first rotating body 181 and the second rotating body 182 are rotated in the second position where the first rotating body 181 and the second rotating body 182 are separated from each other. More specifically, the first rotating body 181 is rotated in the state of being contact with the web W in the second position (refer to FIG. 9). In this case, the pressurizing unit 82 (the calender roller 85) pressurizes (nips) the web W. For this reason, it is possible to prevent the movement of the web W toward the downstream side in the transport direction and to eliminate the waste of the web W. Note that, the pressure (load) on the web W of the pressurizing unit 82 (the calender roller 85) when the heating unit 84 is positioned in the second position may be set to be smaller than the pressure (load) on the web W of the pressurizing unit 82 (the calender roller 85) when the heating unit 84 is positioned in the first position. In this way, it is possible to reduce occurrence of indentation of the web W.

Note that, in step S15, the rotational speed of the first rotating body 181 may be set higher. That is, the rotational speed of the first rotating body 181 in the second position may control the driving such that the rotational speed of the first rotating body 181 in the second position is higher than the rotational speed of the first rotating body 181 in the first position. In this way, the cooling of the first rotating body 181 is accelerated, and thus it is possible to reliably prevent web W from sticking to the first rotating body 181.

Subsequently, the temperature of the outer circumferential surface of the first rotating body 181 is obtained in step S16. Note that, in the embodiment, the temperature of the outer circumferential surface of each of the first rotating body 181 and the second rotating body 182 is obtained. Specifically, detected date is obtained from the temperature measurement unit of each of the first rotating body 181 and the second rotating body 182.

Next, in step S17, it is determined whether or not the temperature of the outer circumferential surface of the first rotating body 181 and the second rotating body 182 is equal to or lower than a predetermined temperature. Specifically, it is determined whether or not the temperature of the outer circumferential surface of the first rotating body 181 is equal to or lower than a predetermined temperature, and the temperature of the outer circumferential surface of the second rotating body 182 is equal to or lower than a predetermined temperature. Note that, a predetermined temperature in the outer circumferential surface of the first rotating body 181 and a predetermined temperature on the outer circumferential surface of the second rotating body 182 may be the same temperature or different temperature. In addition, in a case where it is determined that the temperature of the outer circumferential surface of each of the first rotating body 181 and the second rotating body 182 is equal to or lower than a predetermined temperature (YES), the process proceeds to step S18, and in a case where it is determined that the temperature of the outer circumferential surface of each of the first rotating body 181 and the second rotating body 182 is not equal to or lower than a predetermined temperature (NO), the process proceeds to step S16.

Next, in a case where the process proceeds to step S18, rotatable driving of the first rotating body 181 and the second rotating body 182 is stopped. Specifically, the driving of the transmission mechanism 200 is stopped by transmitting the control signal to the driving unit 201. With this, the rotating of the first rotating body 181 and the second rotating body 182 is stopped in the second position where the first rotating body 181 and the second rotating body 182 are separated from each other. In this way, when the rotating of the first rotating body 181 and the second rotating body 182 is stopped after the temperature of the outer circumferential surface of the first rotating body 181 and the second rotating body 182 is equal to or lower than a predetermined temperature, it is possible to reliably prevent web W from sticking to the first rotating body 181, and it is possible to reduce power consumption of the driving unit 201. As described above, the transport stop process is completed.

Note that, in the above-described transport stop process, the process of step S13 may be performed before the process of step S12, or both may be performed at the same time.

Next, the transport start process will be described.

As illustrated in FIG. 12, it is determined whether or not the transport of the web W is started in step S21. At this time, the heating unit 84 is in the second position where the first rotating body 181 and the second rotating body 182 are separated from each other. In the case where it is determined that the transport of the web W is started in step S21, for example, in the case where the user performs an operation for starting the manufacturing of the sheet (YES), the process proceeds to step S22. On the other hand, in the case where the transporting of the web W is not started (NO), the process proceeds to step S21.

Next, in a case where the process proceeds to step S22, rotatable driving of the first rotating body 181 and the second rotating body 182 is started. Specifically, the transmission mechanism 200 is driven by transmitting the control signal to the driving unit 201. With this, the first rotating body 181 and the second rotating body 182 are rotatably driven in the second position.

Next, the heat source H is operated in step S23. Specifically, the operations of the heat source H of the first rotating body 181 and the heat source H of the heating body 183 for heating the second rotating body 182 are performed by transmitting the control signal. The first rotating body 181 and the second rotating body 182 are heated while being rotated in the second position, and thereby it is possible to make the surface temperature of the first rotating body 181 and the second rotating body 182 uniform in the circumferential direction. In a case where the heating is performed in a state where the second rotating body 182 is stopped, only a portion in contact with the heating body 183 is heated, and thereby it is not possible to make the surface temperature of the second rotating body 182 uniform in the circumferential direction. Further, if the heating is performed in a state where the first rotating body 181 is stopped, the heat from the heat source H is unevenly transmitted due to the influence of convection or the like, and thereby it is not possible to make the surface temperature of the first rotating body 181 in the circumferential direction.

Next, in step S24, the temperature of the outer circumferential surface of each of the first rotating body 181 and the second rotating body 182 is obtained. Specifically, detected date is obtained from the temperature measurement unit of each of the first rotating body 181 and the second rotating body 182.

Next, in step S25, it is determined whether or not the temperature of the outer circumferential surface of the first rotating body 181 and the second rotating body 182 reaches a predetermined temperature. Specifically, it is determined whether or not the temperature of the outer circumferential surface of the first rotating body 181 reaches a predetermined temperature, and the temperature of the outer circumferential surface of the second rotating body 182 reaches a predetermined temperature. Note that, a predetermined temperature in the outer circumferential surface of the first rotating body 181 and a predetermined temperature on the outer circumferential surface of the second rotating body 182 may be the same temperature or different temperature. In addition, in a case where it is determined that the temperature of the outer circumferential surface of each of the first rotating body 181 and the second rotating body 182 reaches a predetermined temperature (YES), the process proceeds to step S26, and in a case where it is determined that the temperature of the outer circumferential surface of each of the first rotating body 181 and the second rotating body 182 reaches a predetermined temperature (NO), the process proceeds to step S24.

Next, in step S26, the position of the heating unit 84 is displaced from the second position to the first position. Specifically, the position of the heating unit 84 is displaced to the first position by transmitting the control signal to the motor applied to the displacement mechanism 190. With this, a state (the second position) where the first rotating body 181 and the second rotating body 182 of the heating unit 84 are separated from each other is changed to a state (the first position) where the web W is nipped by the first rotating body 181 and the second rotating body 182. At this time, the position may be displaced to the first position in the state where the first rotating body 181 and the second rotating body 182 are rotated, or the position may be displaced to the first position in the state where the rotation of the first rotating body 181 and the second rotating body 182 is stopped, and after the displacement to the first position, the rotation of the first rotating body 181 and the second rotating body 182 may be started again.

Subsequently, the transporting of the web W (sediment) is started in step S27. Specifically, the tensioned roller 74, the pressurizing unit 82 (the calender roller 85), the heating unit 84 (the first rotating body 181 and the second rotating body 182), the transport roller pairs 97 and 98, and the like are started by transmitting the control signal. With this, the transport of the web W (the sheet S) is started (refer to FIG. 8). As described above, the transport start process is completed.

Note that, in the above-described transport start process, the process of step S23 may be performed before the process of step S22, or both may be performed at the same time.

As described above, in the sheet manufacturing apparatus 100A according to the embodiment and a method of controlling the sheet manufacturing apparatus 100A, it is possible to obtain the following effects.

When the transporting of the web W is stopped, the first rotating body 181 and the second rotating body 182 are separated from each other by displacing the heating unit 84 to the second position from the first position, and the first rotating body 181 being in contact with the web W is rotatably driven in the second position. With this, it is possible to reliably prevent web W from sticking to the first rotating body 181.

Third Embodiment

Next, the third embodiment will be described. Note that, a basic configuration of the sheet manufacturing apparatus according to the embodiment is the same as the configuration of the second embodiment, and thus the description thereof will not be repeated, and mainly different parts of the configuration will be explained.

Figure 13:
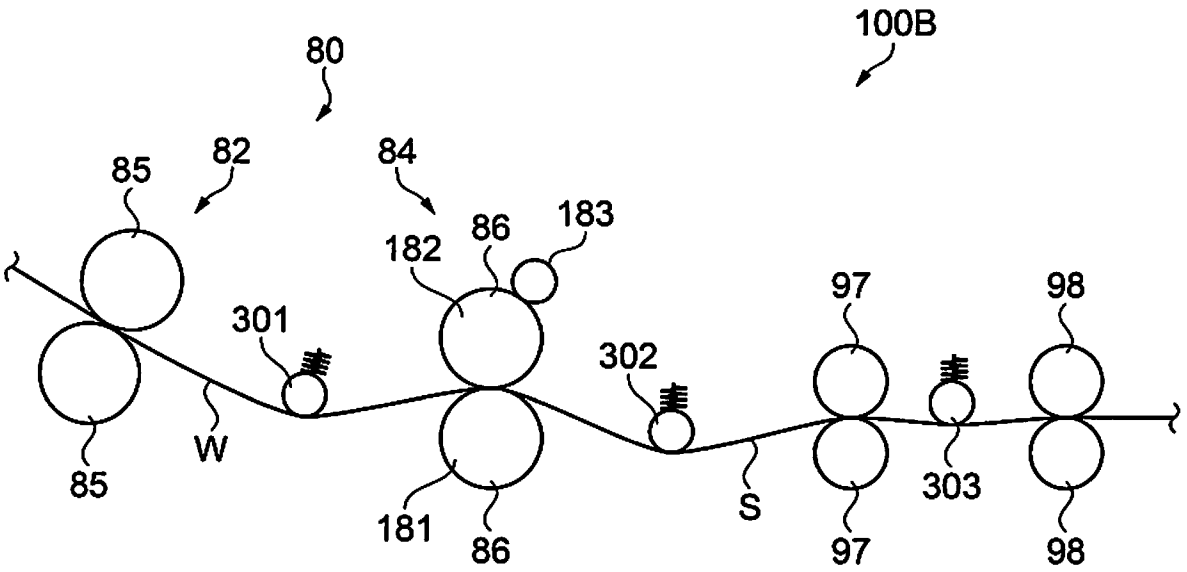
FIG. 13 is a schematic view illustrating a configuration of a sheet manufacturing apparatus according to a third embodiment.

FIG. 13 is a schematic view illustrating the configuration of the sheet manufacturing apparatus according to the embodiment. In detail, FIG. 13 is a schematic view illustrating configurations of the heating unit and the periphery of the heating unit. Ai illustrated in FIG. 13, the sheet manufacturing apparatus 100B is provided with the pressurizing unit 82 (a pair of the calender rollers 85) as a first transport unit which is positioned on the upstream side of the heating unit 84 (the heating roller 86) in the transport direction of the web W, and is capable of transporting the web W (the sheet S), and the transport roller pair 97 as a second transport unit which is positioned on the downstream side in the transport direction of the web W (the sheet S) as a sediment from the heating unit 84 (the heating roller 86). The heating unit 84 includes the first rotating body 181, the second rotating body 182, and the heating body 183. In addition, the transport roller pair 98 is disposed on the downstream side in the transport direction of transport roller pair 97. Note that, the configurations of the pressurizing unit 82, the heating unit 84, the transport roller pairs 97 and 98 are the same as those in the second embodiment, and thus the description thereof will not be repeated.

Further, in the sheet manufacturing apparatus 100B, a first tension roller 301 is disposed between the pressurizing unit 82 and the heating unit 84, a second tension roller 302 is disposed between the heating unit 84 and the transport roller pair 97, and a third tension roller 303 is disposed between the transport roller pair 97 and the transport roller pair 98, on a transport route of the web W. The first to third tension rollers 301, 302, and 303 are configured to be able to be biased toward the web W (the sheet S) in the gravity direction, and to apply tension to the web W (the sheet S). That is, in the manufacturing of the sheet S, the web W (the sheet S) is transported while forming a certain amount of slackness (buffer) of the web W (the sheet S) between the pressurizing unit 82 and the heating unit 84, between the heating unit 84 and the transport roller pair 97, and between the transport roller pair 97 and the transport roller pair 98.

In addition, a position detection unit (for example, a micro switch, a light detection sensor, or the like) that detects the position of each of the first to third tension rollers 301, 302, and 303 is provided. Note that, in the embodiment, an upper limit position of each of the first to third tension rollers 301, 302, and 303 is detected. That is, the minimum slack state of the web W (the sheet S) is detected. Although the upper limit position of each of the first to third tension rollers 301, 302, and 303 can be optionally set, in order to prevent the occurrence of damage of the web W (the sheet S), the upper limit position may be set so as to be detected in the state where the web W (the sheet S) has slight slackness. Note that, the position detection unit is connected to the controller 104A. In addition, when the heating unit 84 is positioned in the second position, the controller 104A causes the web W (the sheet S) to reciprocate by the pressurizing unit 82 and the transport roller pair 97.

Figure 14:
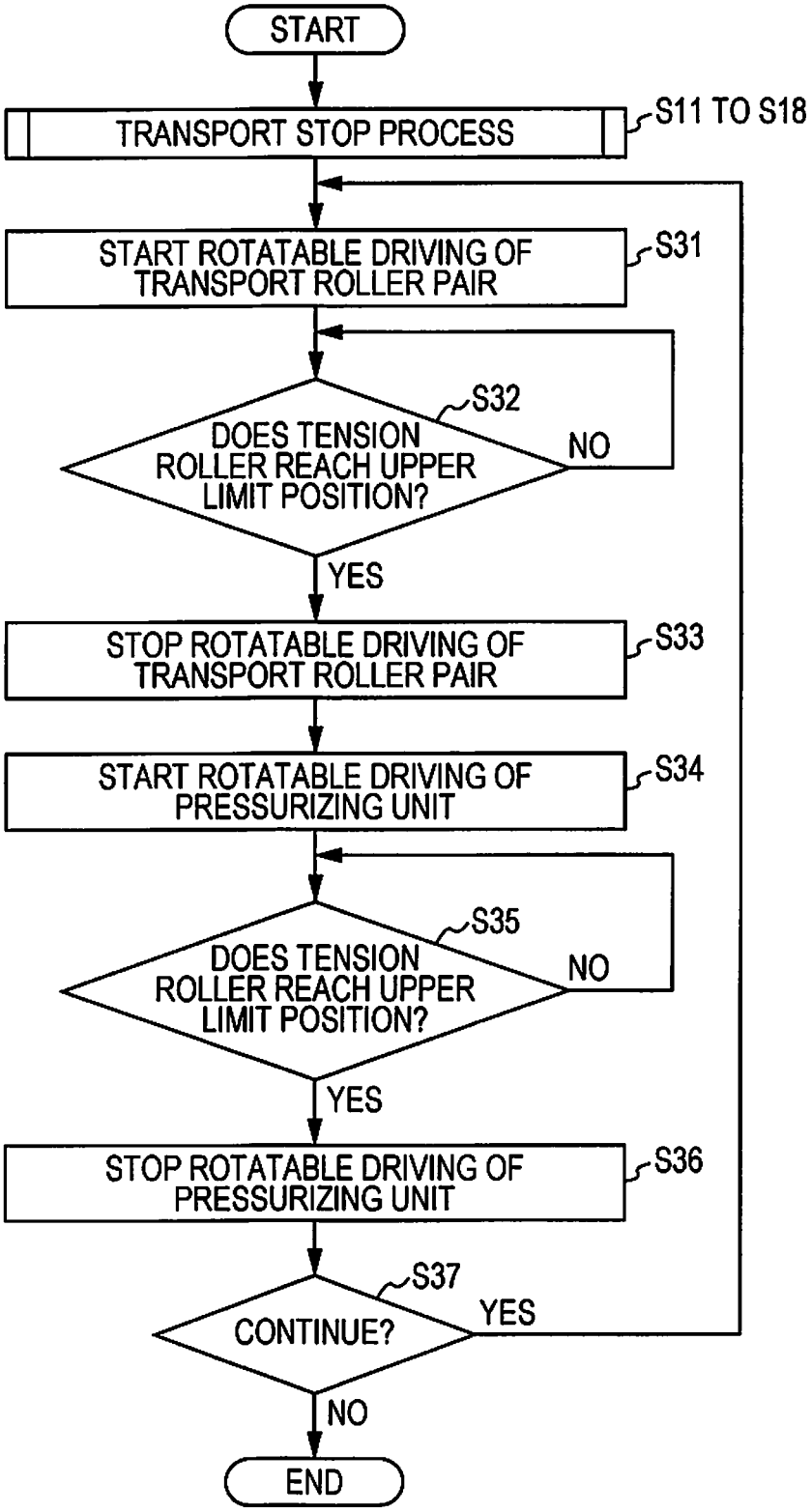
FIG. 14 is a flow chart illustrating a method of controlling the sheet manufacturing apparatus according to the third embodiment.
Figure 15:
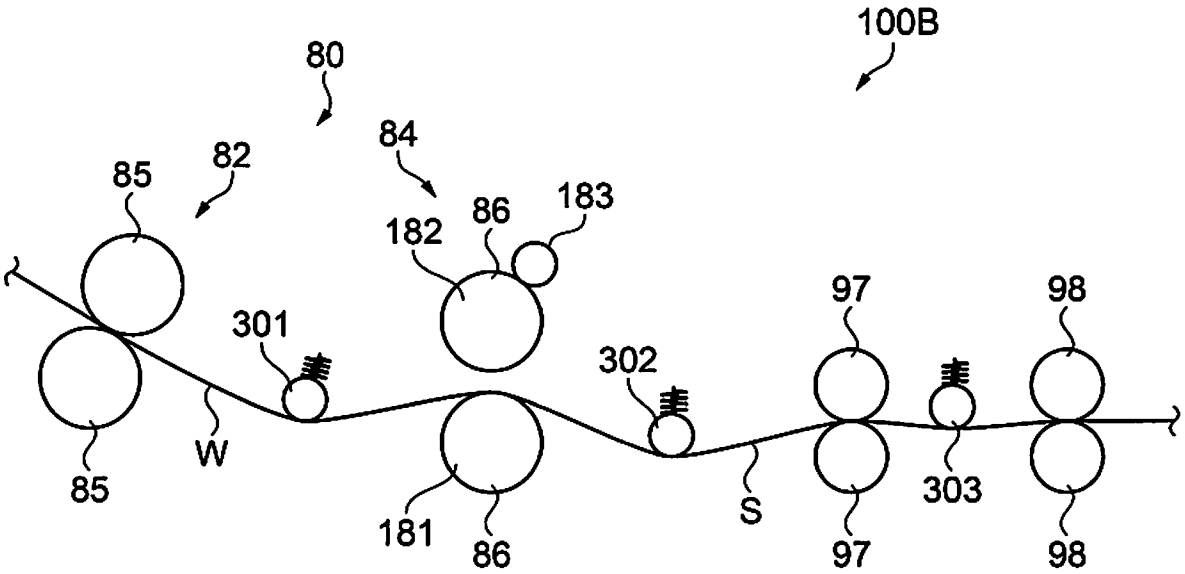
FIG. 15 is a schematic view illustrating a method of operating the sheet manufacturing apparatus according to the third embodiment.
Figure 16:
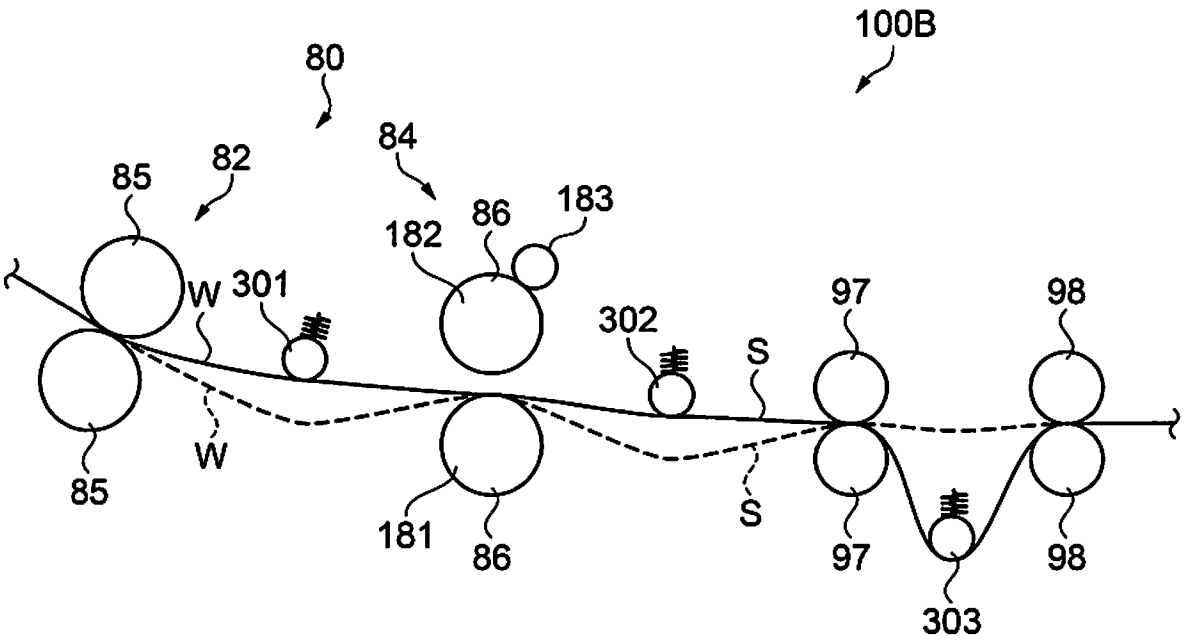
FIG. 16 is a schematic view illustrating a method of operating the sheet manufacturing apparatus according to the third embodiment.

Next, a method of controlling the sheet manufacturing apparatus will be described. FIG. 14 is a flow chart illustrating a method of controlling the sheet manufacturing apparatus according to the embodiment. Further, FIG. 15 and FIG. 16 are schematic views illustrating a method of operating the sheet manufacturing apparatus.

As illustrated in FIG. 14, first, the transport stop process (step S11 to step S18) is performed. Note that, the content of the transport stop process (step S11 to step S18) is the same as the content of the second embodiment, and thus the description thereof will not be repeated (refer to FIG. 11). In addition, as illustrated in FIG. 15, the position of the heating unit 84 is displaced to the second position by the transport stop process (step S11 to step S18), and the first rotating body 181 and the second rotating body 182 are separated from each other. In addition, the pair of the calender rollers 85 of the pressurizing unit 82 is not rotatably driven in the state of nipping the web W. Further, the transport roller pairs 97 and 98 are not rotatably driven in the state of nipping the sheet S. In addition, at this time, the slackness (buffer) of the web W (the sheet S) is formed between the pressurizing unit 82 and the heating unit 84, between the heating unit 84 and the transport roller pair 97, and between the transport roller pair 97 and the transport roller pair 98.

Next, the transport roller pair 97 is rotatably driven in step S31. Specifically, the transport roller pair 97 is rotatably driven such that the sheet S is transported to the transport roller pair 98 by transmitting the control signal. With this, as illustrated in FIG. 16, the slackness (buffer) of the web W (the sheet S) which is formed between the pressurizing unit 82 and the heating unit 84 and between the heating unit 84 and the transport roller pair 97 is decreased, and the slackness (buffer) formed between the transport roller pair 97 and the transport roller pair 98 is increased. With this, the first tension roller 301 disposed between the pressurizing unit 82 and the heating unit 84 is moved upward. In addition, the second tension roller 302 disposed between the heating unit 84 and the transport roller pair 97 is moved upward. On the other hand, the third tension roller 303 disposed between the transport roller pair 97 and the transport roller pair 98 is moved downward.

Next, it is determined whether or not the first tension roller 301 or the second tension roller 302 reaches the upper limit position in step S32. Specifically, the determination is performed based on the detected date of the position detection unit corresponding to the first tension roller 301 or the position detection unit corresponding to the second tension roller 302. In addition, in a case there it is determined that the first tension roller 301 or the second tension roller 302 reaches the upper limit position (YES), the process proceeds to step S33, and in a case where it is determined that the first tension roller 301 or the second tension roller 302 does not reach the upper limit position (NO), the process returns to step S32.

Note that, in step S32, in a case where one tension of the first tension roller 301 and the second tension roller 302 reaches the upper limit position, it may be determined that it reaches the upper limit position, and in step S32, in a case where both tensions of the first tension roller 301 and the second tension roller 302 reach the upper limit position, it may be determined that it reaches the upper limit position.

Next, in a case where the process proceeds to step S33, rotatable driving of the transport roller pair 97 is stopped by transmitting the control signal. With this, the transporting of the sheet S by the transport roller pair 97 is stopped.

Next, a pair of the calender rollers 85 of the pressurizing unit 82 is rotatably driven in step S34. Specifically, the calender roller 85 is rotatably driven such that the web W is transported to the upstream side in the transport direction of the heating unit 84 by transmitting the control signal. With this, as illustrated in FIG. 15, the slackness (buffer) formed between the transport roller pair 97 and the transport roller pair 98 is decreased, the slackness (buffer) of the web W (the sheet S) which is formed between the pressurizing unit 82 and the heating unit 84 and between the heating unit 84 and the transport roller pair 97 is increased. With this, the third tension roller 303 disposed between the transport roller pair 97 and the transport roller pair 98 is moved upward. On the other hand, the first tension roller 301 disposed between the pressurizing unit 82 and the heating unit 84 is moved downward, and the second tension roller 302 disposed between the heating unit 84 and the transport roller pair 97 is also moved downward.

Next, in step S35, it is determined whether or not the third tension roller 303 reaches the upper limit position. Specifically, the determination is performed based on the detected date of the position detection unit corresponding to the third tension roller 303. In addition, in a case there it is determined that the first tension roller 301 or the second tension roller 302 reaches the upper limit position (YES), the process proceeds to step S36, and in a case where it is determined that the first tension roller 301 or the second tension roller 302 does not reach the upper limit position (NO), the process returns to step S35.

Next, in a case where the process proceeds to step S36, rotatable driving of the calender roller 85 of the pressurizing unit 82 is stopped by transmitting the control signal. With this, the transporting of the web W by the calender roller 85 is stopped. That is, the reciprocation of the web W (the sheet S) is completed.

Next, it is determined whether or not the reciprocation of the web W (the sheet S) is continued in step S37. In a case where the reciprocation is determined to be continued (YES), the process proceeds to step S31, and in a case where the reciprocation is determined not to be continued (NO), the process ends. Note that, whether or not to continue the reciprocation of the web W (the sheet S) may be determined by prescribing the number of the reciprocations of the web W (the sheet S), or may be determined by time (timer setting). Further, it may be determined by the temperature of the outer circumferential surface of the first rotating body 181.

Note that, in the embodiment, the reciprocation of the web W (the sheet S) is performed after performing the process from step S11 to step S18 in the transport stop process; however, the embodiment is not limited thereto. For example, the process may proceed to step S31 after performing the process from step S11 to step S15 in the transport stop process.

As described above, in the sheet manufacturing apparatus 100B according to the embodiment and a method of controlling the sheet manufacturing apparatus 100B, it is possible to obtain the following effects.

The heating unit 84 is positioned in the second position, the web W (the sheet S) is reciprocated in the transport direction. With this, the amount of heat received by the resin contained in the web W (the sheet S) can be dispersed by radiant heat from the heating unit 84, particularly from the first rotating body 181, and it is possible to prevent the web W (the sheet S) from sticking to the first rotating body 181.

Fourth Embodiment

Next, the fourth embodiment will be described. Note that, a basic configuration of the sheet manufacturing apparatus according to the embodiment is the same as the configuration of the second embodiment, and thus the description thereof will not be repeated, and mainly different parts of the configuration will be explained.

Figure 17:
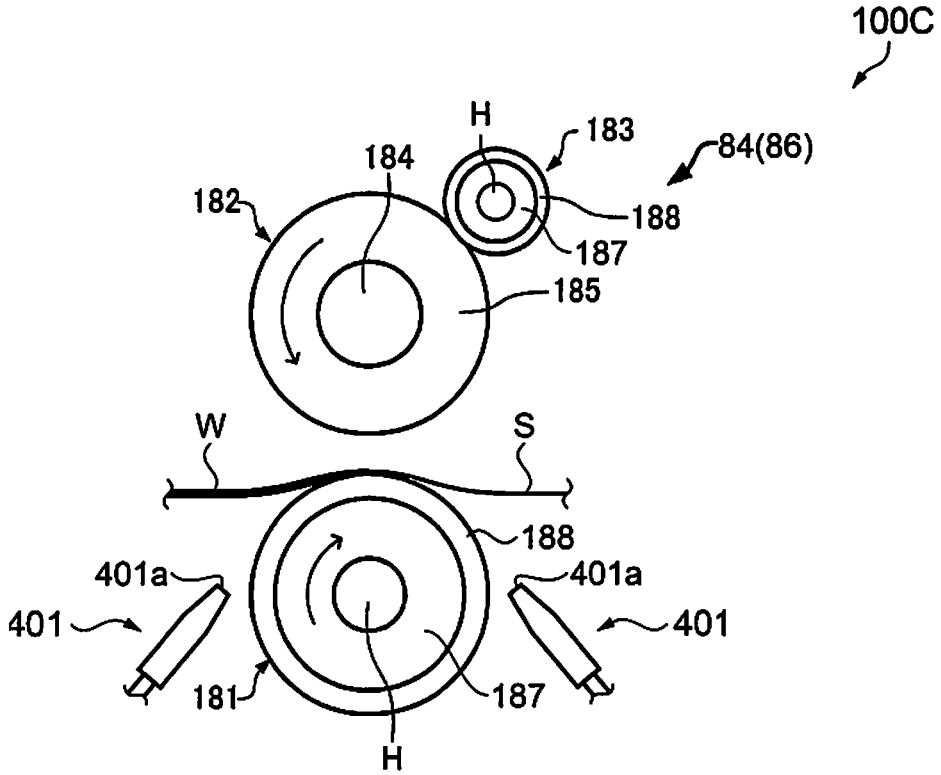
FIG. 17 is a schematic view illustrating a configuration of a sheet manufacturing apparatus according to a fourth embodiment.

FIG. 17 is a schematic view illustrating the configuration of the sheet manufacturing apparatus according to the embodiment. In detail, it is a schematic diagram illustrating a configuration around the heating unit. As illustrated in FIG. 17, when the heating unit 84 is in the second position, the sheet manufacturing apparatus 100C is provided with a blower 401 for blowing air to the first rotating body 181 being in contact with the web W (the sheet S). Note that, the configuration of the heating unit 84 is the same as the configuration of the second embodiment, and thus the description will not be repeated.

The blower 401 is provided with an air nozzle 401*a*, and can discharge the air which is supplied from an air supplying unit (not shown) from the air nozzle 401*a*. The shape of the air nozzle 401*a* is not particularly limited, and may be, for example, a wide flat shape or a shape radially expelling air.

In addition, the air nozzle 401*a* is disposed to face the top portion (a portion being in contact with the web W (the sheet S)) of the first rotating body 181. In the embodiment, the air is discharged from the air nozzle 401*a* disposed on each of the upstream side and the downstream side in the transport direction of the web W (the sheet S) of the first rotating body 181.

In a case where the driving unit of the blower 401 is connected to the controller 104A, and the heating unit 84 is positioned in the second position, the driving signal is received from the controller 104A so as to drive the blower 401, thereby discharging the air from the air nozzle 401*a*.

Further, the pressure of the air discharged from the air nozzle 401*a* can be appropriately set, and when the air is discharged toward the top portion of the first rotating body 181, the air pressure is preferably such an extent that the first rotating body 181 and the web W (the sheet S) are separated from each other.

As described above, according to the embodiment, the following effects can be obtained.

In the case where the heating unit 84 is in the second position, the first rotating body 181 receives air from the blower 401, and thus the cooling of the first rotating body 181 can be accelerated. In addition, it is possible to cool the web W (the sheet S) as well.

The invention includes a configuration substantially the same as that described in the embodiment (for example, a configuration having the same function, method, and result, or a configuration having the same object and effect). Further, the invention includes a configuration in which non-essential parts of the configuration described in the embodiment are replaced. Further, the invention includes a configuration that can achieve the same effects as the configuration described in the embodiment, or a configuration that can achieve the same object. In addition, the invention includes a configuration in which a well-known technique is added to the configuration described in the embodiment.

The invention is not limited to the above-described embodiments, and it is possible to omit a part of the configuration within a scope having the features and effects described in this application, or to add various modifications, improvements, and the like to the above-described embodiments. Further, the above-described embodiments and modifications may be combined.

Note that, regarding the manufacturing units 102 and 102A, a part of the configuration thereof may be omitted, other configurations may be added thereto, or the configuration thereof may be replaced with a known configuration within a range in which sheets can be manufactured.

Modification Examples of the above-described embodiments will be described below.

Modification Example 1

Figure 18:
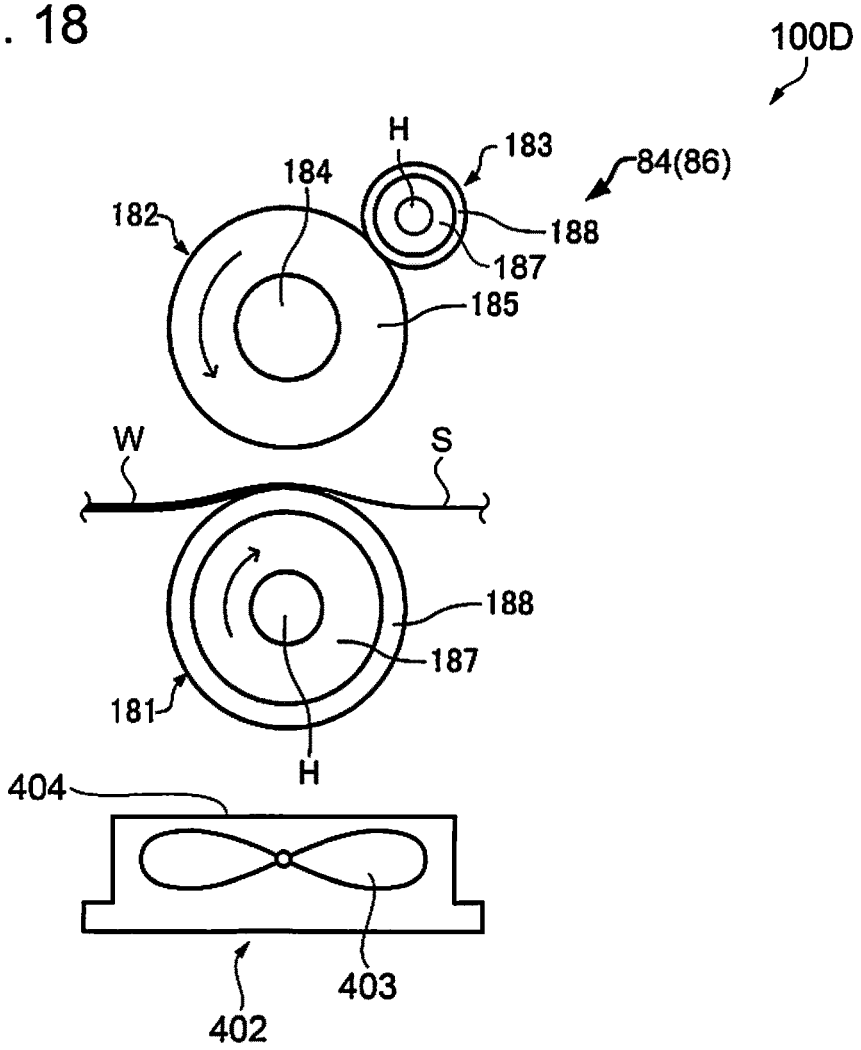
FIG. 18 is a schematic view illustrating a configuration of a sheet manufacturing apparatus according to Modification Example 1.

In the fourth embodiment, the blower 401 having the air nozzle 401*a* for discharging the air to the first rotating body 181 is provided, but the embodiment is not limited to this configuration. For example, a configuration to include a fan for blowing air to the first rotating body 181. FIG. 18 is a schematic view illustrating a configuration of a sheet manufacturing apparatus according to Modification Example. In detail, it is a schematic diagram illustrating a configuration around the heating unit. As illustrated in FIG. 18, when the heating unit 84 is in the second position, a sheet manufacturing apparatus 100D is provided with the fan 402 for blowing air to the first rotating body 181 being in contact with the web W (the sheet S).

The fan 402 includes an impeller 403, and by rotating the impeller 403, an air current is generated so as to blow the air from the exhaust port 404. The fan 402 is disposed below the first rotating body 181 such that the exhaust port 404 faces the first rotating body 181. In a case where the driving unit of the fan 402 is connected to the controller 104A, and the heating unit 84 is positioned in the second position, the driving signal is received from the controller 104A so as to drive the fan 402, thereby blowing the air from the exhaust port 404. The air blown from the exhaust port 404 flows along the outer circumferential surface of the first rotating body 181 from the lower portion of the first rotating body 181 toward the top portion of the first rotating body 181. In this way, in the case where the heating unit 84 is in the second position, the entire of the first rotating body 181 receives the air from the fan 402, and thus the cooling of the first rotating body 181 can be accelerated. In addition, it is possible to cool the web W (the sheet S) as well.

Modification Example 2

Figure 19:
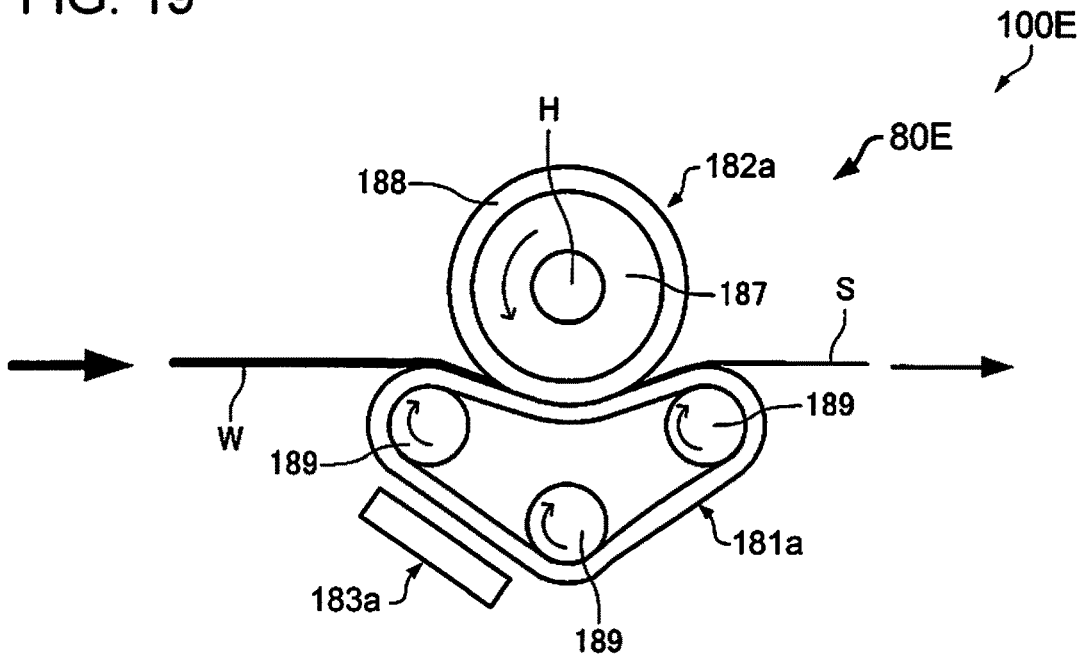
FIG. 19 is a schematic view illustrating a configuration of a sheet manufacturing apparatus according to Modification Example 2.

In the above-described embodiments, a case where the shapes of the first rotating body 181 and the second rotating body 182 are formed into a roller shape was described; however, at least one of the first rotating body 181 and the second rotating body 182 may be formed into a belt shape. FIG. 19 is a schematic view illustrating a configuration of a sheet manufacturing apparatus according to Modification Example. As illustrated in FIG. 19, a sheet forming unit 80E of a sheet manufacturing apparatus 100E is provided with a first rotating body 181*a* and a second rotating body 182*a*. The first rotating body 181*a* of the sheet forming unit 80E has a belt stretched around a roller 189 and rotatably driven by the roller, and the second rotating body 182*a* is a heating roller having the heat source H inside. In the example illustrated in FIG. 19, the belt of the first rotating body 181*a* is heated by the heating body 183*a* which is non-contact heater. Even in this case, the same effect as described above can be obtained.

Modification Example 3

In the second embodiment, the temperature measurement unit that detects a surface temperature of each of the first rotating body 181 and the second rotating body 182 is provided, and in the transport stop process of the web W (the sheet S), in a case where the surface temperature of the first rotating body 181 and the second rotating body 182 is equal to or lower than a predetermined temperature, the rotatable driving of the first rotating body 181 and the second rotating body 182 is stopped; however, the embodiment is not limited to this configuration. For example, a timer is installed in the sheet manufacturing apparatus, the heating unit 84 measures the time from the point in time when the heating unit 84 is displaced to the second position, and the rotatable driving of the first rotating body 181 and the second rotating body 182 may be stopped based on the measured time data. In this case, the timer may set in advance the time during which the surface temperature of the first rotating body 181 and the second rotating body 182 is equal to or lower than a predetermined temperature. Even in this case, the same effect as described above can be obtained.

REFERENCE SIGNS LIST

1 . . . HOPPER
2, 3, 7, 8 . . . PIPE
9 . . . HOPPER
10 . . . SUPPLYING UNIT
12 . . . CRUSHING UNIT
14 . . . CRUSHING BLADE
20 . . . DEFIBRATING UNIT
22 . . . INTRODUCTION PORT
24 . . . EXIT PORT
40 . . . SCREENING UNIT
41 . . . DRUM PORTION
42 . . . INTRODUCTION PORT
43 . . . HOUSING PORTION
44 . . . EXIT PORT
45 . . . FIRST WEB FORMING UNIT
46 . . . MESH BELT
47 . . . TENSIONED ROLLER
48 . . . SUCTION UNIT
49 . . . ROTATING BODY
49*a* . . . BASE PORTION
49*b* . . . PROJECTION
50 . . . MIXING UNIT
52 . . . ADDITIVE AGENT SUPPLYING UNIT
54 . . . PIPE
56 . . . BLOWER
60 . . . ACCUMULATION UNIT
61 . . . DRUM PORTION
62 . . . INTRODUCTION PORT
63 . . . HOUSING PORTION
70 . . . SECOND WEB FORMING UNIT
72 . . . MESH BELT
74 . . . TENSIONED ROLLER
76 . . . SUCTION MECHANISM
78 . . . MOISTURE-ADJUSTING UNIT
80 . . . SHEET FORMING UNIT
82 . . . PRESSURIZING UNIT
84 . . . HEATING UNIT
85 . . . CALENDER ROLLER
86 . . . HEATING ROLLER
90 . . . CUTTING UNIT
92 . . . FIRST CUTTING UNIT
94 . . . SECOND CUTTING UNIT
96 . . . DISCHARGE UNIT
100 . . . SHEET MANUFACTURING APPARATUS
102 . . . MANUFACTURING UNIT
104 . . . CONTROLLER
181 . . . FIRST ROTATING BODY
182 . . . SECOND ROTATING BODY
183 . . . HEATING BODY
184 . . . CORE BAR
185 . . . SOFT BODY
186 . . . SUPPORTING UNIT
187 . . . CORE BAR
188 . . . RELEASING LAYER
189 . . . ROLLER
190 . . . DISPLACEMENT MECHANISM
191 . . . ROTATION AXIS
192 . . . ROTATION AXIS
193 . . . FIRST BEARING PORTION
194 . . . SECOND BEARING PORTION
195*a* . . . FIRST ROD
195*b* . . . SECOND ROD
196, 197*a*, 197*b* . . . ROTATION AXIS
198 . . . BIASING MEMBER
199 . . . THE OTHER END
200 . . . TRANSMISSION MECHANISM
201 . . . DRIVING UNIT
202 . . . DRIVE GEAR
203 . . . MAIN GEAR
204 . . . FIRST GEAR
205 . . . SECOND GEAR
206 . . . THIRD GEAR
207 . . . FOURTH GEAR
R . . . DIRECTION
S . . . SHEET
V . . . WEB
W . . . WEB

The invention claimed is:

1. A sheet manufacturing apparatus which manufactures a sheet by using a raw material containing a fiber, the apparatus comprising:

an accumulation unit that accumulates a material containing a fiber and a resin;

a heating unit that includes a first rotating body and a second rotating body, and heats a sediment of the material accumulated by the accumulation unit to form the sheet;

a displacement mechanism that displaces the heating unit to a first position where the first rotating body and second rotating body nip and heat the sediment of the material and a second position where the first rotating body and the second rotating body are spaced apart from each other; and a controller that is electrically connected to the displacement mechanism and controls the displacement mechanism to displace the first rotating body and the second rotating body to the first position after controlling the heating unit to heat the first rotating body and the second rotating body in the second position.

2. The sheet manufacturing apparatus according to claim 1, wherein the controller controls the displacement mechanism to displace the heating unit to the first position from the second position after a temperature of the heating unit reaches a predetermined temperature at the time of starting transport of the sediment.

3. The sheet manufacturing apparatus according to claim 1, wherein the controller controls the displacement mechanism to displace the heating unit from the first position to the second position at the time of stopping transport of the sediment.

4. The sheet manufacturing apparatus according to claim 1, wherein when the heating unit is in the second position, the controller controls the heating unit such that a peripheral speed of the first rotating body is different from a peripheral speed of the second rotating body.

5. The sheet manufacturing apparatus according to claim 1, further comprising:

a driving unit that rotatably drives the first rotating body; and a transmission mechanism that transmits a driving force of the driving unit to the second rotating body in the second position without transmitting the driving force of the driving unit to the second rotating body in the first position.

6. The sheet manufacturing apparatus according to claim 1, wherein the first rotating body and the second rotating body are not in contact with the sediment in the second position.

* * * * *